US012429234B2

(12) United States Patent
Li et al.

(10) Patent No.: US 12,429,234 B2
(45) Date of Patent: Sep. 30, 2025

(54) AIR CONDITIONING OUTDOOR UNIT AND AIR CONDITIONER THEREWITH

(71) Applicants: GD MIDEA HEATING & VENTILATING EQUIPMENT CO., LTD., Foshan (CN); HEFEI MIDEA HEATING & VENTILATING EQUIPMENT CO., LTD., Hefei (CN)

(72) Inventors: Yuefei Li, Foshan (CN); Dongdong Yu, Foshan (CN); Zhenjiang Zhan, Foshan (CN); Jinghui Feng, Foshan (CN); Lihua Ma, Foshan (CN); Feng Yang, Foshan (CN); Yandong Wu, Foshan (CN); Bingxin Liu, Foshan (CN); Qizhen Wang, Foshan (CN); Naitong Liu, Foshan (CN)

(73) Assignees: GD MIDEA HEATING & VENTILATING EQUIPMENT CO., LTD., Foshan (CN); GD MIDEA HEATING & VENTILATING EQUIPMENT CO., LTD., Hefei (CN)

( * ) Notice: Subject to any disclaimer, the term of this patent is extended or adjusted under 35 U.S.C. 154(b) by 37 days.

(21) Appl. No.: 18/564,098

(22) PCT Filed: May 13, 2022

(86) PCT No.: PCT/CN2022/092672
§ 371 (c)(1),
(2) Date: Nov. 26, 2023

(87) PCT Pub. No.: WO2023/016009
PCT Pub. Date: Feb. 16, 2023

(65) Prior Publication Data

US 2024/0255161 A1 Aug. 1, 2024

(30) Foreign Application Priority Data

Aug. 7, 2021 (CN) ..... 202110904994.X
Aug. 7, 2021 (CN) ..... 202110904995.4
Aug. 7, 2021 (CN) ..... 202110904998.8
Aug. 7, 2021 (CN) ..... 202110905006.3

(51) Int. Cl.
*F24F 1/22* (2011.01)
*F24F 1/10* (2011.01)

(52) U.S. Cl.
CPC . *F24F 1/22* (2013.01); *F24F 1/10* (2013.01)

(58) Field of Classification Search
CPC ..... F24F 1/22; F24F 1/10; F24F 1/38; F24F 1/40; F24F 1/46; F24F 1/50; F24F 1/56
(Continued)

(56) References Cited

U.S. PATENT DOCUMENTS

2009/0137197 A1* 5/2009 Jang ..... F24F 1/50 454/184
2016/0054011 A1* 2/2016 Katayama ..... F04D 29/5826 415/175

FOREIGN PATENT DOCUMENTS

CN 102967009 A 3/2013
CN 205137735 U 4/2016
(Continued)

OTHER PUBLICATIONS

EESR Received in EP Application No. 22854997.8; mailed Jan. 13, 2025.
(Continued)

*Primary Examiner* — Steve S Tanenbaum
(74) *Attorney, Agent, or Firm* — K&L Gates LLP

(57) ABSTRACT

The present disclosure relates to the field of air conditioners, and in particular to an air conditioning outdoor unit and an air conditioner therewith. The present disclosure provides an
(Continued)

air conditioning outdoor unit, including: a case, where an air outlet is provided at a top of the case, and a compressor assembly is provided at a bottom of the case; a wind turbine, where the wind turbine is arranged at the top of the case and is located at a position of the air outlet; and an electronic control box, where the electronic control box is arranged at the case, and a distance between a bottom of the electronic control box and the bottom of the case is $Z_2$, $Z_2 \geq 0.8 \times h$, h being a height of the compressor assembly. In the air conditioning outdoor unit of the present disclosure.

20 Claims, 12 Drawing Sheets

(58) Field of Classification Search
USPC ..... 62/259.1
See application file for complete search history.

(56) References Cited

FOREIGN PATENT DOCUMENTS

| | | | |
|---|---|---|---|
| CN | 109084383 | A | 12/2018 |
| CN | 209181132 | U | 7/2019 |
| CN | 111486515 | A | 8/2020 |
| CN | 111486516 | A | 8/2020 |
| EP | 1577616 | A1 | 9/2005 |
| EP | 2762792 | B1 | 8/2018 |
| JP | H06281204 | A | 10/1994 |
| JP | 2003130394 | A | 5/2003 |
| JP | 2004156800 | A | 6/2004 |
| JP | 2011137610 | A | 7/2011 |
| JP | 2016121864 | A | 7/2016 |
| WO | 2013145012 | A1 | 10/2013 |

OTHER PUBLICATIONS

ISR received in PCT/CN2022/092672; malled Jul. 5, 2022.
The first Office Action received in the counterpart CN application 202110904994.X, mailed on May 16, 2025, 16 pages with English translation.
The first Office Action received in the counterpart CN application 202110904998.8, mailed on May 16, 2025, 14 pages with English translation.
The first Office Action received in the counterpart CN application 202110905006.3, mailed on May 15, 2025, 12 pages with English translation.

* cited by examiner

AIR CONDITIONING OUTDOOR UNIT AND AIR CONDITIONER THEREWITH

CROSS-REFERENCES TO RELATED APPLICATIONS

The present disclosure is a national phase application of International Application No. PCT/CN2022/092672, filed on May 13, 2022, which claims priority to and the benefit of the Chinese patent applications with the application numbers 202110905006.3, 202110904994.X, 202110904995.4, and 202110904998.8, which were filed with China National Intellectual Property Administration on Aug. 7, 2021, the entire contents of which are incorporated herein by reference.

FILED

The present disclosure relates to the field of air conditioners, and in particular to an air conditioning outdoor unit and an air conditioner therewith.

BACKGROUND

This section merely provides background information related to the present disclosure and is not necessarily prior art.

The fan module of an air conditioning outdoor unit includes a wind turbine, a wind guiding ring, a motor, a motor bracket, and the like, and when designing the air conditioning outdoor unit, it is often required to maintain low operating noise and a high aerodynamic efficiency while ensuring to provide a high air volume. An electronic control box is often arranged at one side of the inside of the air conditioning outdoor unit, however, since the electronic control box is located at the air inlet of the wind turbine or at the air inlet channel of the wind turbine, the electronic control box blocks a part of the air inlet channel, resulting in a decrease in the air output of the air conditioning outdoor unit. At the same time, the presence of the electronic control box interferes with the otherwise uniform airflow of the wind turbine and the turbulent airflow creates additional aerodynamic noise.

SUMMARY

The present disclosure provides an air conditioning outdoor unit, and on the premise of ensuring the normal operation and convenient maintenance of the air conditioning outdoor unit, by rationally arranging the distance between the electronic control box and the bottom of the case, the height direction of the electronic control box can be flexibly adjusted, to reduce the influence of the electronic control box on the ventilation and noise inside the air conditioning outdoor unit.

The present disclosure also proposes an air conditioner including the above air conditioning outdoor unit.

The air conditioning outdoor unit of the present disclosure includes a case, where an air outlet is provided at a top of the case, and a compressor assembly is provided at a bottom of the case; a wind turbine, where the wind turbine is arranged at the top of the case and is located at a position of the air outlet; and an electronic control box, where the electronic control box is arranged at the case, and a distance between a bottom of the electronic control box and the bottom of the case is $Z_2$, $Z_2 \geq 0.8 \times h$, h being a height of the compressor assembly.

The implementations of the present application improve the airfield and noise inside the case by adjusting the position of the electronic control box, specifically, on the premise of ensuring the normal operation and convenient maintenance of the air conditioning outdoor unit, by rationally arranging the distance between the electronic control box and the bottom of the case, the height direction of the electronic control box can be flexibly adjusted, to reduce the influence of the electronic control box on the ventilation and noise inside the air conditioning outdoor unit. Furthermore, by adjusting the distance between the electronic control box and the bottom of the case, the axial distance between the electronic control box and the wind turbine is indirectly adjusted, to improve the influence of the electronic control box on the flow field of the wind turbine inlet and the inlet noise.

In some implementations of the present disclosure, a projection of the electronic control box toward the bottom of the case along a vertical direction is outside the compressor assembly.

In some implementations of the present disclosure, a top of the compressor assembly is an arc-shaped structure, and the height h of the compressor assembly is a maximum distance between the top of the compressor assembly and the bottom of the case.

In some implementations of the present disclosure, a distance between a top of the electronic control box and a bottom of the wind turbine is $Z_1$, and $0.1 \times D \leq Z_1 \leq 0.2 \times D$, D being a diameter of the wind turbine.

In some implementations of the present disclosure, the electronic control box is a rectangular structure, a length direction of the electronic control box is distributed along a length direction of the case, and a length of the electronic control box is greater than a height of the electronic control box.

In some implementations of the present disclosure, the electronic control box is a rectangular structure, a height direction of the electronic control box is distributed along a height direction of the case, and a height of the electronic control box is greater than a length of the electronic control box.

In some implementations of the present disclosure, the compressor assembly includes a compressor and a mounting support, the mounting support is provided at a baseplate of the case, and the compressor is mounted on the baseplate through the mounting support.

The air conditioning outdoor unit of the present disclosure includes: a case, where an air outlet is provided at a top of the case; a wind turbine, where the wind turbine is arranged at the top of the case and is located at the air outlet; and an electronic control box, where the electronic control box is arranged at the case and is located below the wind turbine, and a width of a projection of the electronic control box falling on the wind turbine along a vertical direction is T, and $T \leq 0.15 \times D$, D being a diameter of the wind turbine.

In the air conditioning outdoor unit of the present disclosure, the embodiments of the present application propose to improve the airfield and noise inside the case by adjusting the position of the electronic control box, and in particular, in the case where the wind guiding ring is provided on the air outlet side of the wind turbine, the wind guiding ring is not located in the air channel of the wind turbine, and by limiting the width of the electronic control box, the majority of the electronic control box can be located below the wind guiding ring, the shielding of the air inlet and the air channel of the wind turbine by the electronic control box can be reduced, facilitating the improvement of the air volume and controlling the interference noise.

The air conditioning outdoor unit of the present disclosure includes a case, where an air outlet is provided at the top of the case; at least two wind turbines, where at least two wind turbines are arranged at the air outlet; an electronic control box, where the electronic control box is arranged on the case and spans two adjacent wind turbines and is located below the two adjacent wind turbines, the projected area of the electronic control box on the wind turbines in the vertical direction is S, then $0.5(2\times S1+S2)\leq S\leq(2\times S1+S2)$, where $$S1 = R\cdot T\cdot \sin(a) - \frac{(A-\sin(a))R^{\wedge}2 + TR\sin(a)}{2},$$

$S2=T\cdot(L_0-2R)$, R is the radius of the wind guiding ring of the wind turbine, T is the width of the projection of the electronic control box on the wind turbine in the vertical direction, a=arccos (R−T/R) with a unit of degree, $A=a\cdot\pi/180$, and $L_0$ is the axial distance between the two adjacent wind turbines.

In the air conditioning outdoor unit of the present disclosure, the embodiments of the present application propose to improve the airfield and noise inside the case by adjusting the position of the electronic control box, in particular, in the case where the wind guiding ring is provided on the air outlet side of the wind turbine, the wind guiding ring is not located in the air channel of the wind turbine, and by limiting the projected area of the electronic control box to S, the majority of the electronic control box can be located below the wind guiding ring, and the shielding of the air inlet and the air channel of the wind turbine by the electronic control box can be reduced, to improve the air volume and control the interference noise.

In some implementations of the present disclosure, the width of the projection of the electronic control box falling on at least two wind turbines in the vertical direction is T, and $T\leq 0.15\times D$; D is the diameter of the wind turbine.

In some implementations of the present disclosure, the air outlet side of the wind turbine is provided with a wind guiding ring, at least part of the electronic control box is located below the wind guiding ring, T=T1−T2, T1 is the width of the part of the electronic control box located inside the case, and T2 is the thickness of the wind guiding ring.

In some implementations of the present disclosure, the case is provided with a support beam located between two adjacent air outlets, and at least a portion of the electronic control box is located below the support beam.

In some implementations of the present disclosure, the distance from the bottom of the electronic control box to the bottom of the case is $Z_2$, $Z_2\geq 0.8\times h$, where h is the height of the compressor assembly within the case.

In some implementations of the present disclosure, the distance between the top of the electronic control box and the bottom of the wind turbine is $Z_1$, then $0.1\times D\leq Z_1\leq 0.2\times D$.

The air conditioning outdoor unit of the present disclosure includes a case, where an air outlet is provided at the top of the case; and a wind turbine, where the wind turbine is arranged at the top of the case and is located at the position of the air outlet; an electronic control box, where the electronic control box is arranged on the case, and $0.1\times D\leq Z_1\leq 0.16\times D$, where D is the diameter of the wind turbine, and $Z_1$ is the distance from the top of the electronic control box to the bottom of the wind turbine.

In the air conditioning outdoor unit of the present disclosure, the airfield inside the case is improved by adjusting the position of the electronic control box, and in particular, the distance from the top of the electronic control box to the bottom of the wind turbine is $Z_1$, and the diameter of the wind turbine is D, so that the influence of the electronic control box on the air volume and noise inside the case can be effectively improved under the satisfied conditions $0.1\times D\leq Z_1\leq 0.2\times D$. In one embodiment, by increasing the axial distance between the electronic control box and the wind turbine, the influence of the electronic control box on the flow field at the air inlet of the wind turbine can be reduced, and in the above-mentioned distance range, the influence of the electronic control box on the wind turbine is small, facilitating the generation of a higher air volume and controlling the noise of the air conditioning outdoor unit.

In some implementations of the present disclosure, the distance from the bottom of the electronic control box to the bottom of the case is $Z_2$, $Z_2\geq 0.8\times h$, where h is the height of the compressor assembly within the case.

In some implementations of the present disclosure, the projection of the electronic control box on the wind turbine in the vertical direction has a dimension T in the width direction and $T\leq 0.15\times D$.

According to some embodiments of the present disclosure, a heat exchanger of an air conditioning outdoor unit is circumferentially disposed along an inner sidewall of a case and is provided with a gap for installing an electronic control box.

In some implementations of the present disclosure, the shape of the heat exchanger is one of a C-type structure, a U-type structure, a G-type structure, and an L-type structure.

In some implementations of the present disclosure, the air conditioning outdoor unit includes a heat exchanger, the length of the electronic control box is a, and $0.5\times A\leq a\leq K$; A is the length of the whole unit of the air conditioning outdoor unit, E is the length of the gap, and K is a smaller value between $0.95\times E$ and $0.9\times A$.

In some implementations of the present disclosure, the air conditioner includes two heat exchangers oppositely arranged along the length direction, the two heat exchangers cooperate to form a gap, and the length of the electronic control box is a, and $0.32\times A\leq a\leq K$, where A is the length of the whole air conditioning outdoor unit, F is the length of the gap, and K is a smaller value between $0.95\times F$ and $0.9\times A$.

In some implementations of the present disclosure, the air conditioning outdoor unit satisfies $(W+\sqrt{R^2-(R-T)^2})-L_0\leq L\leq\sqrt{R^2-(R-T)^2}$; W is a width of the electronic control box, R is an inner diameter of the wind guiding ring of the wind turbine, $L_0$ is an axial distance between the two wind turbines, T is a width of a projection of the electronic control box on the wind turbine along a vertical direction, and L is a distance from one side of the electronic control box to one side of the axis of the wind turbine in an entire length direction of the air conditioning outdoor unit.

In some implementations of the present disclosure, the electronic control box is a rectangular structure, and length direction of the electronic control box is distributed along the length direction of the case, and the length of the electronic control box is greater than or equal to the height of the electronic control box.

In some implementations of the present disclosure, the electronic control box is a rectangular structure, and the height direction of the electronic control box is distributed along the height direction of the case, and the height of the electronic control box is greater than or equal to the length of the electronic control box.

The air conditioning outdoor unit of the present disclosure includes a case, an air wheel, an electronic control box, and a heat exchanger, where an air outlet is provided at the top of the case, the heat exchanger is provided inside the case, and the heat exchanger is provided with a gap for accommodating the electronic control box; the wind turbine is arranged at the top of the case and located at the air outlet; and an electronic control box is provided on the case and is at least partially located at the gap, where the length of the electronic control box is a, and $0.5\times A\leq a\leq K$; A is the length of the air conditioning outdoor unit, E is the length of the gap, and K is a smaller value between $0.95\times E$ and $0.9\times A$.

The air conditioning outdoor unit of the present disclosure and the air conditioning outdoor unit proposed by the embodiments of the present application can flexibly adjust the area where the electronic control box blocks the ventilation channel by rationally setting the length of the electronic control box under the premise of ensuring the normal operation and convenient assembly and disassembly of the electronic control box, and improve the airfield and noise inside the case by adjusting the length of the electronic control box, to minimize the influence of the electronic control box on the ventilation and noise inside the air conditioning outdoor unit.

In the air conditioning outdoor unit of the present disclosure, two heat exchangers are oppositely disposed in a case of the air conditioning outdoor unit along a length direction; the two heat exchangers cooperate to form a gap for accommodating an electronic control box of the air conditioning outdoor unit; at least a portion of the electronic control box is disposed in the gap; and a length of the electronic control box is a and $0.32\times A\leq a\leq K$, A being an entire length of the air conditioning outdoor unit, F being a length of the gap, and K being a smaller value between $0.95\times F$ and $0.9\times A$.

In some implementations, the top of the case is provided with a support beam, the support beam connecting two long sides of the top of the case, and at least a portion of the electronic control box is located below the support beam.

In some implementations, the width of the projection of the electronic control box onto the wind turbine along a vertical direction has a width of T, and $T\leq 0.15\times D$, where D is the diameter of the wind turbine.

In some implementations, the height of the electronic control box is b, then $(H-b)\geq 0.8h$, where H is the vertical distance from the top of the electronic control box to the bottom of the case and h is the height of the compressor assembly within the case.

In some implementations, the electronic control box is a rectangular structure, a length direction of the electronic control box is distributed along a length direction of the case, and a length of the electronic control box is greater than a height of the electronic control box.

In some implementations, the electronic control box is a rectangular structure, a height direction of the electronic control box is distributed along a height direction of the case, and a height of the electronic control box is greater than a length of the electronic control box.

In some implementations, the electronic control box is at least partially disposed within the interior of the case.

In some implementations, the heat exchanger is circumferentially disposed along an inner side wall of the case and is provided with a gap for mounting the electronic control box. In some implementations, the electronic control box is a closed electronic control box.

An air conditioner provided by the present disclosure includes an air conditioning outdoor unit provided by the present disclosure.

Embodiments of the present disclosure will be outlined in part in the description which follows and, in part, will be clear from the description, or may be learned by practice of the present disclosure.

BRIEF DESCRIPTION OF THE DRAWINGS

The drawings are only to illustrate some embodiments and are not to be construed as limiting the present disclosure. Moreover, the same reference symbols are used to represent the same components throughout the drawings. In the drawings.

Figure 1:
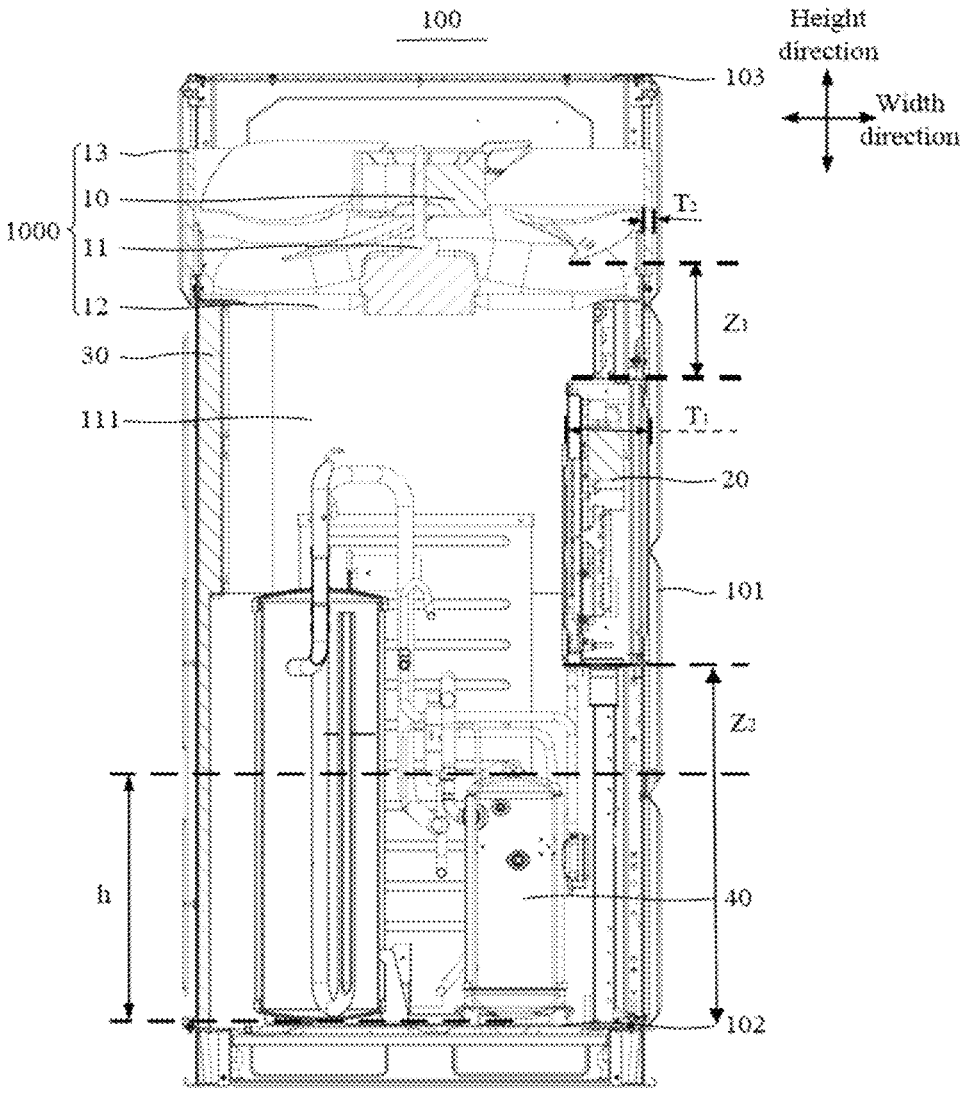
FIG. 1 is a sectional view of an air conditioning outdoor unit according to an embodiment of the present disclosure.

The reference numerals are as follows:

100, air conditioning outdoor unit; 110, case; 111, box body; 101, panel; 102, baseplate; 103, mesh cover; 104, support beam;

1000, fan module; 10, wind turbine; 11, motor; 12, motor bracket; 13, wind guiding ring;

20, electronic control box;

30, heat exchanger; and

40, compressor.

DETAILED DESCRIPTION OF THE DISCLOSURE

Exemplary embodiments of the present disclosure will be described in more detail below regarding the accompanying drawings. While the exemplary embodiments of the present disclosure are shown in the drawings, the present disclosure can be embodied in various forms and should not be construed as limited to the embodiments set forth herein.

It is to be understood that the terminology used herein is to describe specific example embodiments only and is not intended to be limiting. As used herein, the singular forms "a", "an", and "the" are intended to include the plural forms as well, unless the context indicates otherwise. The terms "include/comprise", "contain", and "have" are inclusive and therefore specify the presence of stated features, elements, and/or components, but do not preclude the presence or addition of one or more other features, elements, components, and/or groups thereof.

Furthermore, the terms "first" and "second" are used for descriptive purposes only and are not to be understood as indicating or implying relative importance or implicitly designating the number of features indicated. Thus, a feature defined as "first" and "second" may explicitly or implicitly include one or more of the features. In the description of the present disclosure, the meaning of "a plurality of" is at least two, for example, two, three, and the like unless explicitly specifically limited otherwise.

For ease of description, spatially relative terms, such as "inner", "outer", "on", "between", and the like, may be used herein to describe one element or feature's relationship to another element or feature as illustrated in the drawings. Such spatially relative terms are intended to encompass different orientations of the mechanism in use or operation in addition to the orientation depicted in the drawings. For example, if the mechanism in the drawings is turned over, elements described as "under" or "above" other elements or features would then be oriented "over" or "below" the other elements or features. Thus, the exemplary term "below" can encompass both an orientation of above and below. The mechanism may be otherwise oriented (rotated 90 degrees or in other directions) and the spatially relative descriptors used herein interpreted accordingly.

Figure 2:
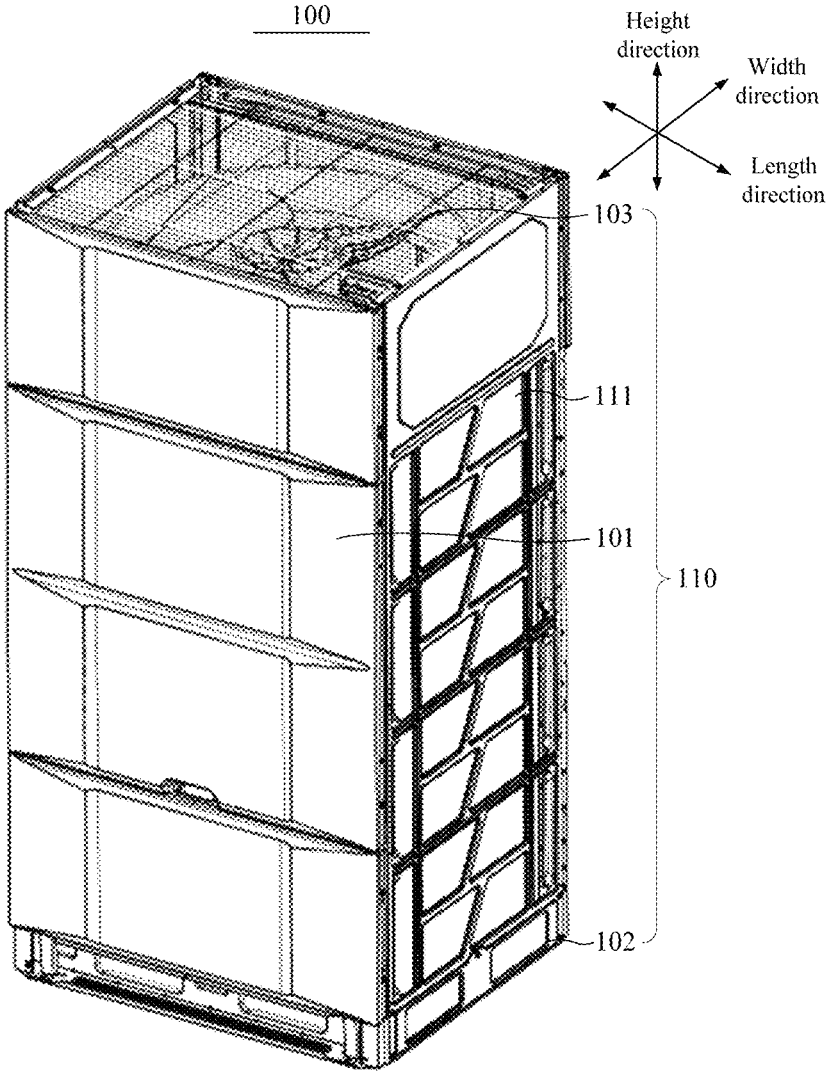
FIG. 2 is an isometric view of an air conditioning outdoor unit according to an embodiment of the present disclosure.

The width direction in the present application is the "width direction" of the case 110 as shown in FIG. 2, the height direction in the present application is the "height direction" of the case 110 as shown in FIG. 2, and the length direction in the present application is the "length direction" of the case 110 as shown in FIG. 2.

First Embodiment

Figure 3:
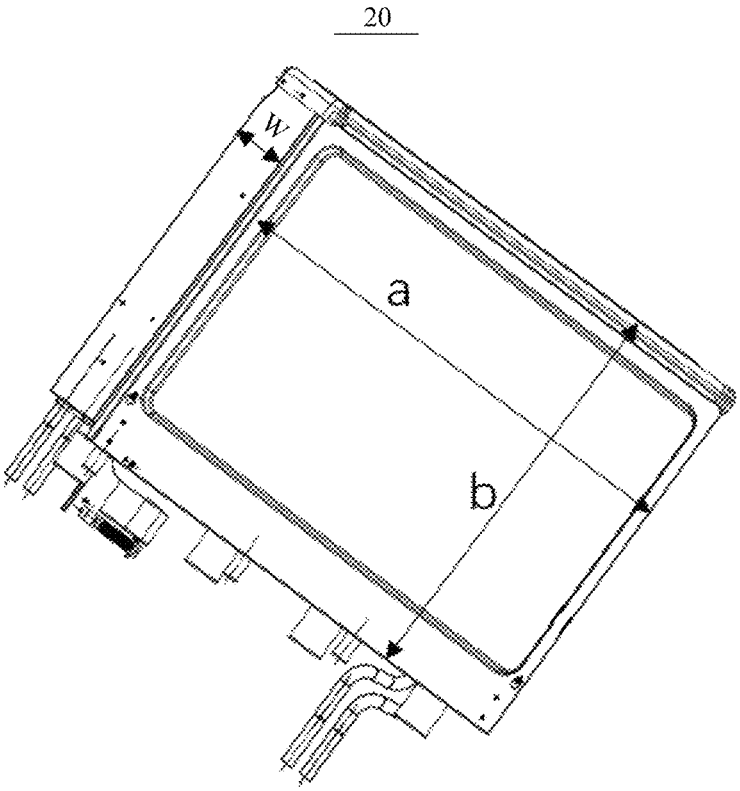
FIG. 3 is a schematic view showing a structure of an electronic control box according to an embodiment of the present disclosure.

As shown in FIGS. 1 to 3, the present disclosure provides an air conditioning outdoor unit 100 including a case 110, a wind turbine 10, and an electronic control box 20, where a top of the case 110 is provided with an air outlet, a bottom of the case 110 is provided with a compressor 40 located in an inner space of the case 110, the wind turbine 10 is provided at the top of the case 110 at the position of the air outlet, the electronic control box 20 is provided at the case 110, and the distance from the bottom of the electronic control box 20 to the bottom of the case 110 is $Z_2$, $Z_2 \geq 0.8 \times h$, and h is the height of the compressor 40.

In the present embodiment, the present application propose to improve the airfield and noise inside the case 110 by adjusting the position of the electronic control box 20, in particular, the air conditioning outdoor unit can flexibly adjust the height direction of the electronic control box 20 by rationally arranging the distance between the electronic control box 20 and the bottom of the case 110 under the premise of ensuring the normal operation and convenient maintenance of the air conditioning outdoor unit, to reduce the influence of the electronic control box 20 on the ventilation and noise inside the air conditioning outdoor unit.

It is to be understood that the present embodiment does not limit the number of the wind turbines, and the number of the wind turbines may be one, two, or any other number. This embodiment also does not limit the number of heat exchangers, and the number of heat exchangers may be one or more.

In one embodiment, the present disclosure provides an air conditioning outdoor unit 100 including a box body 111 and a panel 101. The box body 111 is provided with an opening (as shown in FIG. 2, the opening is located at the panel 101 of the case 110, and the panel 101 covers the opening of the case 110), and the panel 101 is movably connected to the opening to open or close the opening. For example, the panel 101 may be detachably coupled to the box body 111, or the panel 101 may be rotatably coupled to the box body 111. An air outlet is provided at the top of the box body 111.

The number of panels 101 may be one or more. The heat exchanger 30 is provided inside the case 110, an air outlet is provided at the top of the case 110, a fan module 1000 is provided at the top of the case 110 at the position of the air outlet, and a mesh cover 103 is provided at the top of the case 110 at the air outlet side of the air outlet.

The electronic control box 20 is provided in the case 110 at the opening, or the electronic control box 20 is provided at the side of the case 110 near the panel 101, and the electronic control box 20 may be mounted on a support plate (not shown) extending downward from the motor bracket 12. The opening of the case 110 can be opened by adjusting the position of the panel 101 to service the electronic control box 20.

The heat exchanger 30 is disposed inside the case 110 and is circumferentially disposed along an inner wall of the case 110. The heat exchanger 30 is provided with a gap. The gap corresponds to at least a portion of the opening of the box body 111. At least a portion of the electronic control box 20 is disposed in the gap (E is the length of the gap in FIG. 10). The shape of the heat exchanger 30 may be, for example, but not limited to, a C-type structure, a G-type structure, an L-type structure, or a U-type structure.

The fan module 1000 is used to create an airflow. The fan module 1000 may include a wind turbine 10, a motor 11, a motor bracket 12, and a wind guiding ring 13, the top plate of the electronic control box 20 is located below the motor bracket 12, and during the operation of the fan module 1000, air flows from the inside of the case 110 to the wind turbine 10 and flows out from an air outlet at the top. A mesh cover 103 may be provided at the air outlet.

It can be appreciated that the heat exchanger 30 and the electronic control box 20 in the interior of the case 110 are both located in the airflow ventilation channel, the heat exchanger 30 is used for heat exchanging the airflow at the airflow ventilation channel, the heat exchanger 30 is arranged around the periphery of the case 110, the airflow channel almost completely covers the interior space of the case 110, the electronic control box 20 is arranged in the interior space of the case 110, the electronic control box 20 blocks a part of the airflow channel, resulting in a reduction of the air output of the air conditioning outdoor unit 100, and at the same time, the existence of the electronic control box 20 also interferes with the originally uniform air flow of the wind turbine 10, and the turbulent airflow of the wind turbine 10 also generates additional pneumatic noise.

To reduce the influence of the electronic control box 20 on the gas field and noise around the wind turbine 10, the embodiment of the present application proposes the definition of the distance between the electronic control box 20 and the compressor 40 to provide a larger installation range for the installation height of the compressor 40 based on reducing the interference of the electronic control box 20 and the compressor 40 with each other during installation and maintenance, so that the axial distance between the electronic control box 20 and the wind turbine 10 can be indirectly adjusted by adjusting the distance between the electronic control box 20 and the bottom of the case 110, to improve the influence of the electronic control box 20 on the inlet flow field and inlet noise of the wind turbine 10.

In one embodiment, by adjusting the distance between the electronic control box 20 and the bottom of the case 110, the purpose of indirectly adjusting the axial spacing (in the height direction as shown in FIG. 2) between the electronic control box 20 and the wind turbine 10 can be achieved. As shown in FIGS. 1-3, according to an embodiment of the present application, the distance between the top of the electronic control box 20 and the bottom of the wind turbine 10 is $Z_1$, then $0.1\times D\leq Z_1\leq 0.2\times D$; D is the diameter of the wind turbine 10, and $Z_1$ is the distance between the top of the electronic control box 20 and the bottom of the wind turbine 10.

On the premise of ensuring the normal operation and convenient maintenance of the air conditioning outdoor unit 100, by rationally arranging the distance between the electronic control box 20 and the wind turbine 10, the adverse effect of the electronic control box 20 on the air conditioning outdoor unit 100 is reduced, and the air volume loss and noise caused by the electronic control box 20 are reduced. The distance between the top of the electronic control box 20 to the bottom of the wind turbine 10 described in the embodiments of the present disclosure may be selected to be the minimum distance of the vertical distance between the top of the electronic control box 20 to the bottom of the wind turbine 10.

Figure 7:
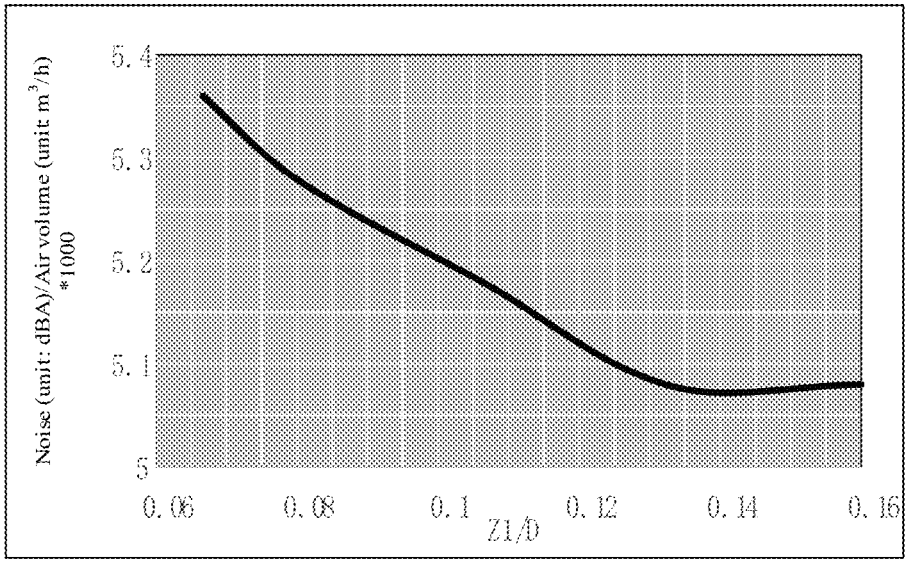
FIG. 7 is a coordinate diagram of noise/air volume—$Z_1/D$ according to an embodiment of the present disclosure.

In particular, if the distance between the top of the electronic control box 20 and the bottom of the wind turbine 10 is $Z_1$, and the diameter of the wind turbine 10 is D, the influence of the electronic control box 20 on the air volume and noise in the case 110 can be effectively improved if $0.1\times D\leq Z_1\leq 0.2\times D$ satisfied, the internal structure and size of the case 110 have a greater influence on the air volume and noise in the case 110, and the air volume and noise generated by different cases 110 are different, and an example of all the different cases 110 will not be given here. As shown in FIG. 7, the embodiments of the present application only illustrate that the amount of wind and noise within one type of case 110 is affected by the distance $Z_1$ from the top of the electronic control box 20 to the bottom of the wind turbine 10.

In one embodiment, by increasing the axial spacing between the electronic control box 20 and the wind turbine 10, the effect of the electronic control box 20 on the flow field at the air inlet of the wind turbine 10 can be reduced, and in the above distance range, especially in the optional range $0.14\times D\leq Z_1\leq 0.16\times D$, the effect of the electronic control box 20 on the wind turbine 10 is small, facilitating the generation of higher wind volumes and noise control. As shown in FIG. 7, when satisfied $0.1\leq Z_1/D\leq 0.16$, the ratio of the noise value to the air volume in the case 110 can be minimum, and in this case, the ratio of the noise value to the air volume in the case 110 is between 5.08 and 5.2, for example, but not limited to: when $Z_1/D=0.1$, the ratio of noise value to air volume is 5.2, when $Z_1/D=0.12$, the ratio of noise value to air volume is 5.12, when $Z_1/D=0.13$, the ratio of noise value to air volume is 5.09, when $Z_1/D=0.14$, the ratio of noise value to air volume is 5.07, and when $Z_1/D=0.16$, the ratio of noise value to air volume is 5.09.

D has a range of values from 500 mm to 920 mm and may be, for example but not limited to: when D=500 mm, 50 mm$\leq Z_1\leq$100 mm; when D=600 mm, 60 mm$\leq Z_1\leq$120 mm; when D=700 mm, 70 mm$\leq Z_1\leq$140 mm; when D=800 mm, 80 mm$\leq Z_1\leq$160 mm; when D=920 mm, 92 mm$\leq Z_1\leq$184 mm.

In some embodiments, the electronic control box 20 is disposed within the interior of the case 110 and the electronic control box 20 is vertically offset from the compressor 40. In the present embodiment, the bottom of the case 110 is provided with a baseplate 102, the compressor assembly includes the compressor 40 and a mounting support provided at the baseplate 102 of the box body 111, the compressor 40 is mounted on the baseplate 102 of the box body 111 through the mounting support, and the height of the compressor assembly includes the height of the compressor 40 and the height of the mounting support.

The electronic control box 20 is arranged inside the case 110, and the electronic control box 20 is staggered from the compressor 40, the distance between the bottom of the electronic control box 20 and the baseplate 102 satisfies $Z_2$, and the embodiment of the present disclosure sets the $Z_2$ value range sufficiently large, that is, the compressor 40 can be taken and placed from the space below the electronic control box 20 by tilting the compressor 40 during the process of assembling and disassembling the compressor 40.

Further, the projection of the electronic control box 20 on the baseplate 102 of the case 110 in the vertical direction is outside the compressor 40, that is, when the electronic control box 20 and the compressor 40 are in a normally assembled state, the electronic control box 20 and the compressor 40 are not in contact with each other, to reduce the phenomenon that the compressor 40 cannot be accessed due to interference between the electronic control box 20 and the compressor 40, and at the same time, the gap therebetween provides a circulation space for the airflow inside the case 110, to improve the circulation efficiency of the air flow inside the case 110.

As shown in FIG. 1, in the case where the wind guiding ring 13 is provided on the air outlet side of the wind turbine 10, at least part of the electronic control box 20 is located below the wind guiding ring 13, and T=T1−T2; T1 is the width of the part of the electronic control box 20 located inside the case 110, and T2 is the thickness of the wind guiding ring 13.

Further, as shown in FIG. 1, the top of the compressor 40 is an arc-shaped structure, and the height of the compressor 40 is a maximum distance between the top of the compressor 40 and the bottom of the case 110, to reduce interference between the top of the compressor 40 and the bottom of the electronic control box 20 during taking and taking the compressor 40.

In addition, the embodiments of the present application can also achieve the purpose of defining the overall height of the electronic control box 20 by defining $Z_1$ value and $Z_2$ value, that is to say, the embodiments of the present application indirectly define the overall height dimension of the electronic control box 20 based on defining the top height and the bottom height of the electronic control box 20, to achieve the purpose of adjusting the air volume and noise at the wind turbine 10 by adjusting the size and height position of the electronic control box 20.

Figure 4:
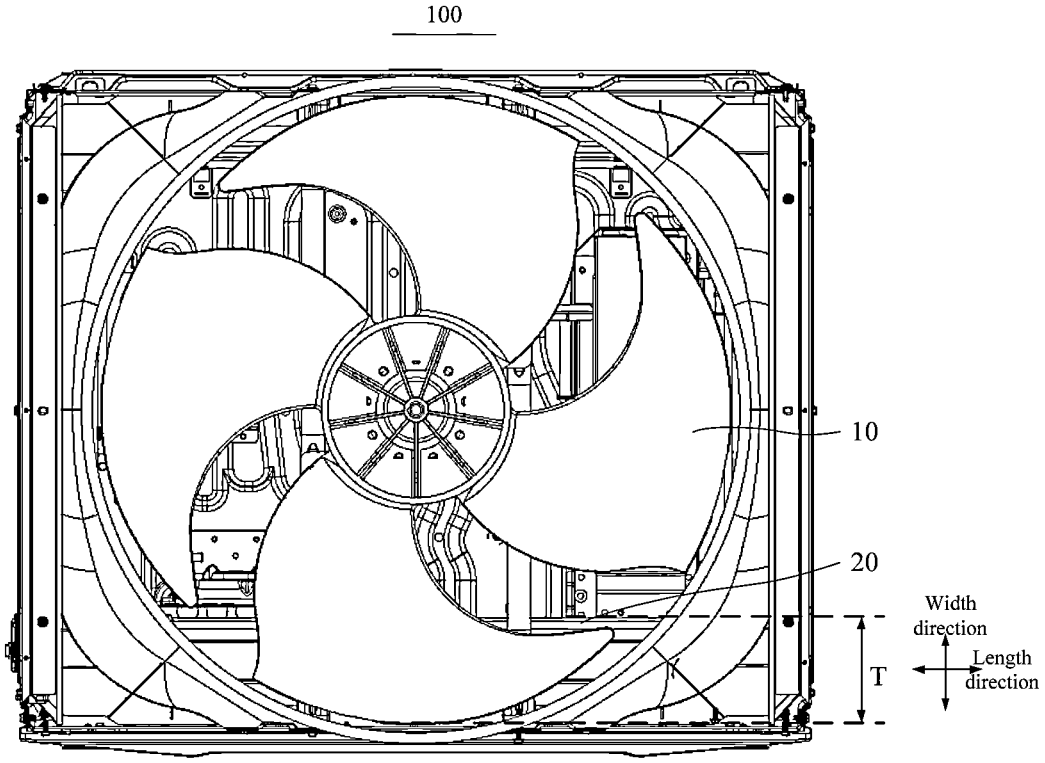
FIG. 4 is a plan view of an air conditioning outdoor unit shown in FIG. 1.
Figure 5:
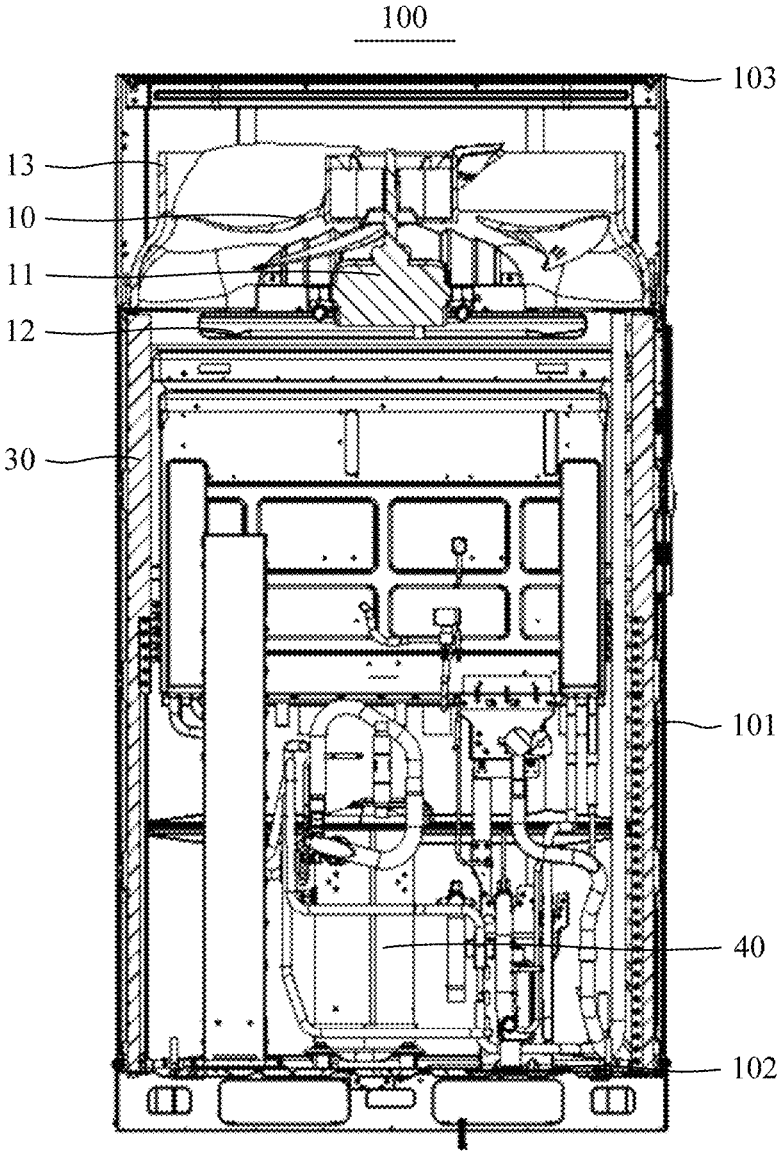
FIG. 5 is a second sectional view of an air conditioning outdoor unit shown in FIG. 1.

As shown in FIGS. 4 and 5, in some embodiments, to reduce the obstruction of the air duct by the electronic control box 20, the embodiment of the present disclosure also proposes that the width dimension of the projection of the electronic control box 20 falling on the wind turbine 10 in the vertical direction is T, T satisfying $T\leq 0.15\times D$.

In the present embodiment, the width dimension of the projection of the electronic control box 20 falling on the wind turbine 10 in the vertical direction is the projection dimension of the part of the electronic control box 20 located in the inner space of the case 110 on the wind turbine 10. The wind guiding ring 13 and a blade tip clearance are provided between the wind turbine 10 and the case 110 of the air conditioning outdoor unit 100, and the projected size of the part of the electronic control box 20 located inside the case 110 on the wind turbine 10 in the embodiment of the present application includes the width of the part of the electronic control box 20 located inside the case 110 minus the thickness of the wind guiding ring 13 and the width of the blade tip clearance.

As shown in FIG. 1, in the case where the wind guiding ring 13 is provided on the air outlet side of the wind turbine 10, at least part of the electronic control box 20 is located below the wind guiding ring 13, and T=T1−T2; T1 is the width of the part of the electronic control box 20 located inside the case 110, and T2 is the thickness of the wind guiding ring 13.

In addition, the embodiment of the present application indirectly defines the width dimension of the electronic control box 20 based on defining the projection dimension of the part of the electronic control box 20 located inside the case 110 on the wind turbine 10, to achieve the purpose of adjusting the wind volume and noise by adjusting the size and position of the electronic control box 20.

Figure 8:
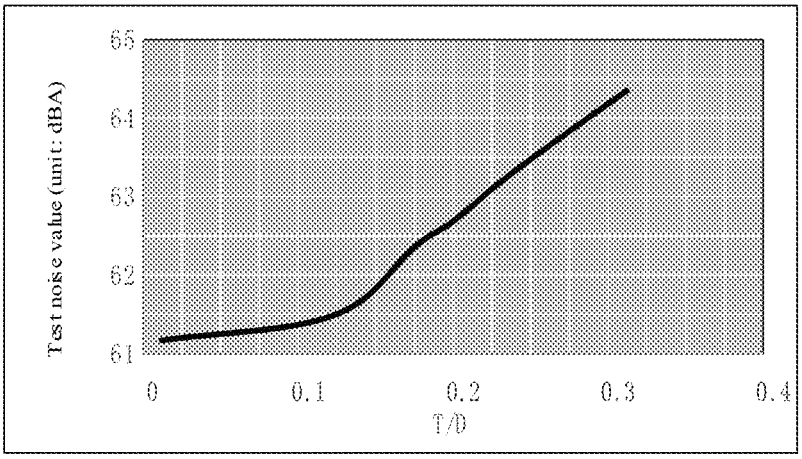
FIG. 8 is a coordinate diagram of noise value—T/D according to an embodiment of the present disclosure.

Furthermore, the width dimension of the projection of the electronic control box 20 falling on the wind turbine 10 in the vertical direction can be selected as $T \leq 0.1 \times D$: the lower limit of the value range of T is determined according to the actual design requirements of the electronic control box 20; the presence of the electronic control box 20 blocks the air inlet of the wind turbine 10, and at the same time reducing the amount of air inlet, also causes the phenomenon of uneven air inlet of the wind turbine 10; and the embodiment of the present application is one of the effective methods for reducing the influence of the electronic control box 20 on the inlet flow field of the wind turbine 10 by reducing the width of the electronic control box 20. As shown in FIG. 8, through experiments, in the case $T/D \leq 0.15$, the influence of the electronic control box 20 on the flow field and noise at the inlet of the wind turbine 10 is minimal, the noise at the inlet of the wind turbine 10 can be reduced to 61.58 or less, for example, but not limited to: when T/D=0.1, the noise value is 61.4 dBA, when T/D=0.08, the noise value is 61.4 dBA, when T/D=0.06, the noise value is 61.3 dBA, when T/D=0.04, the noise value is 61.2 dBA, when=T/D=0.02, the noise value is 61.1 dBA.

Alternatively, a support beam 104 is provided in the middle of the case 110, at least part of the electronic control box 20 is located below the support beam 104, and the support beam 104 is not located in the air channel of the air conditioning outdoor unit 100. The embodiment of the present application proposes that at least part of the electronic control box 20 is located below the support beam 104 between two adjacent wind turbines 10, to reduce the shielding of the wind channel at the inlet of the wind turbines 10 by the electronic control box 20, facilitating the improvement of the air volume and controlling interference noise. The support beam 104 of the present application does not define a shape. A structure located at the middle part of the top of the case 110 and connecting two sides of the top of the case 110 for increasing the strength of the top of the case 110 can be understood as a support beam 104.

As shown in FIGS. 2 and 3, in some embodiments, the air conditioning outdoor unit 100 includes the heat exchanger 30, the length of the electronic control box 20 is a, and $0.5 \times A \leq a \leq K$; A is the entire length of the air conditioning outdoor unit 100, E is the length of the gap, and K is a smaller value between $0.95 \times E$ and $0.9 \times A$. The number of heat exchangers 30 is, for example, one.

In the present embodiment, by setting the length of the electronic control box 20 to a, and $0.5 \times A \leq a \leq K$; it is possible to reduce the interference of the electronic control box 20 with the air conditioning outdoor unit 100 and the heat exchanger 30 while allowing for sufficient electric components to be installed inside the electronic control box 20. Furthermore, the electronic control box 20 is located inside the air conditioning outdoor unit 100, and the wind turbine 10 of the air conditioning outdoor unit 100 is provided with a wind guiding ring 13 and a blade tip clearance between the machine case 110, the air channel inside the machine case 110 does not include the wind guiding ring 13 and the blade tip clearance, and the part of the electronic control box 20 along the length direction has less influence on the air channel. The embodiments of the present application propose to set the length of the electronic control box 20 to a larger size range to make up for the size limitation of the electronic control box 20 in the width direction.

Figure 10:
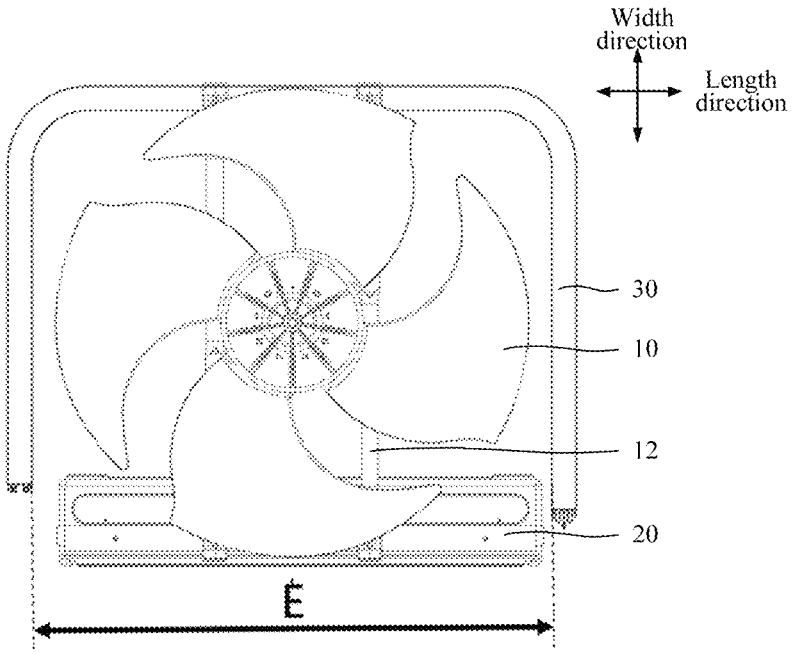
FIG. 10 is a partial plan view of an air conditioning outdoor unit according to an embodiment of the present disclosure.

In some embodiments, the heat exchanger 30 of the air conditioning outdoor unit 100 is circumferentially disposed along the inner sidewall of the case 110 and is provided with a gap (the length E of the gap is shown in FIG. 10) for receiving the electronic control box 20.

In the present embodiment, the shape of the heat exchanger 30 can be, for example, but is not limited to, a C-shaped structure, a G-shaped structure, an L-shaped structure or a U-shaped structure; the C-shaped heat exchanger is arranged around three sides of the case 110, so that the ventilation channel inside the case 110 is also distributed around the inner space of the case 110; the gap of the C-shaped heat exchanger is used for accommodating the electronic control box 20, to reduce the influence of the electronic control box 20 on the airflow after the heat exchange is completed; and at the same time, arranging the electronic control box 20 at the gap of the C-shaped heat exchanger can also reduce the interference between the electronic control box 20 and the C-shaped heat exchanger. Assembly and maintenance replacement of the electronic control box 20 and the type C heat exchanger is facilitated.

Figure 11:
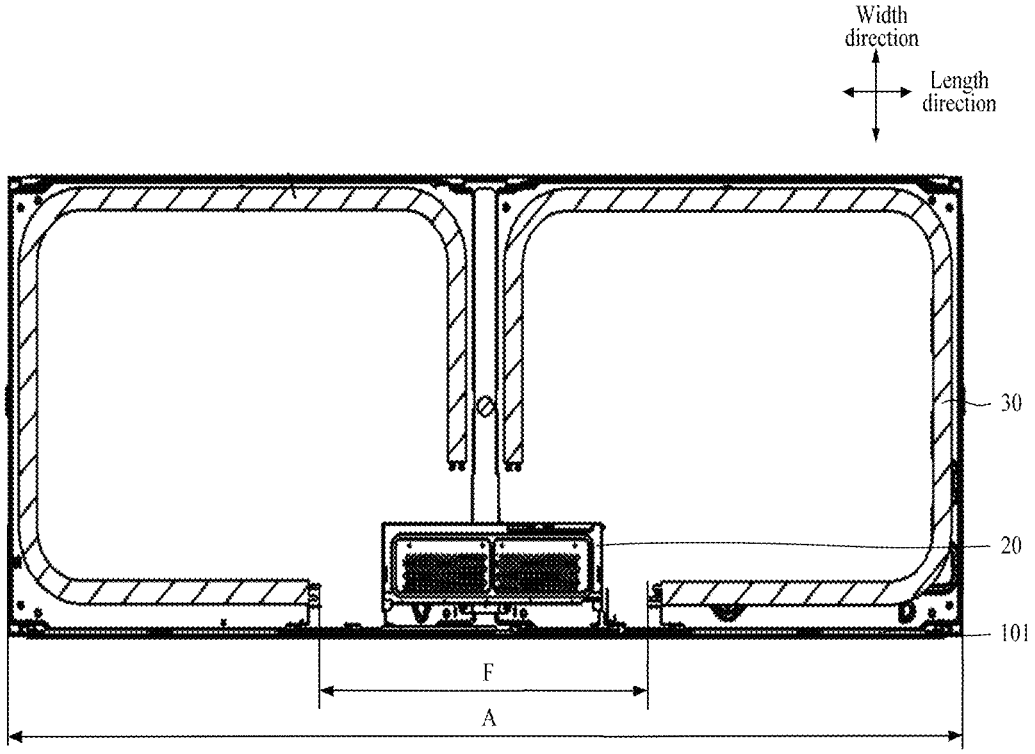
FIG. 11 is a partial plan view of an air conditioning outdoor unit according to another embodiment of the present disclosure.
Figure 12:
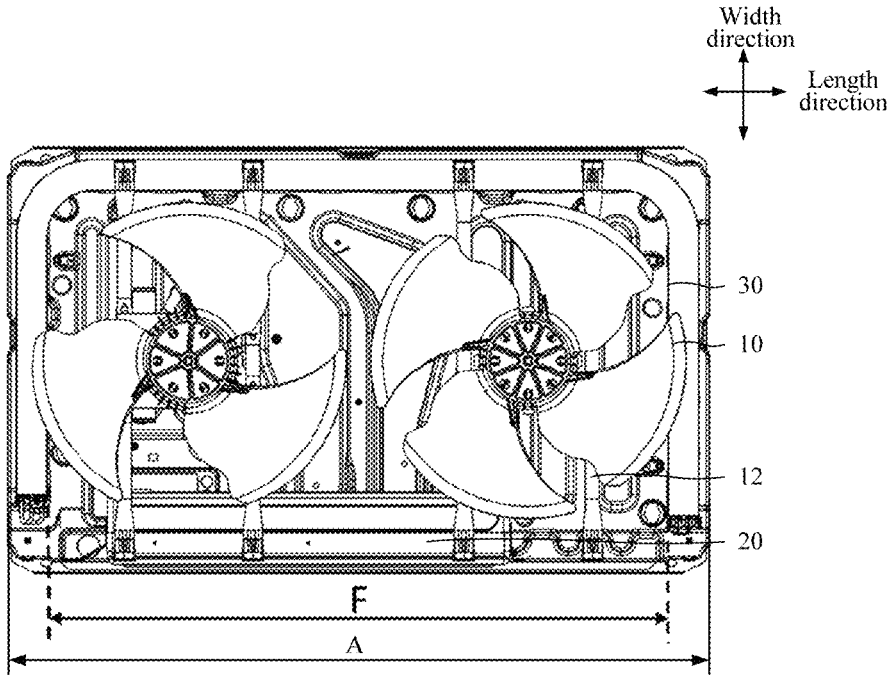
FIG. 12 is a partial plan view of an air conditioning outdoor unit according to another embodiment of the present disclosure.

As shown in FIGS. 11 and 12, in some embodiments, the air conditioning outdoor unit 100 includes two heat exchangers 30 oppositely disposed along a length direction. The two heat exchangers 30 cooperate to form a gap for receiving the electronic control box 20. The length of the electronic control box 20 is a, and $0.32 \times A \leq a \leq K$, where A is the whole length of the air conditioning outdoor unit 100 and F is the length of the gap, K being a smaller value between $0.95 \times F$ and $0.9 \times A$.

The embodiments of the present application provide that two adjacent heat exchangers 30 cooperate to form a gap for accommodating the electronic control box 20, to reduce interference between the electronic control box 20 and the heat exchangers 30 during the process of crossing the air conditioning outdoor unit 100 and reducing the influence of the electronic control box 20 on the air volume and noise in the case 110 by defining the length a of the electronic control box 20.

As shown in FIG. 12, in some embodiments, the air conditioning outdoor unit 100 may be further provided with a U-shaped heat exchanger disposed around the inner wall of the case 110.

In some embodiments, the case 110 is a rectangular structure, the air outlet at the top of the case 110 is provided in a rectangular structure or a circular structure, and the wind guiding ring 13 is provided in a circular structure. By arranging the electronic control box 20 inside the case 110, the electronic control box 20 can be located at the corner between the wind guiding ring 13 and the case 110, to minimize the interference of the electronic control box 20 on the air passage and improving the ventilation performance and noise reduction capability of the wind turbine 10.

Figure 6:
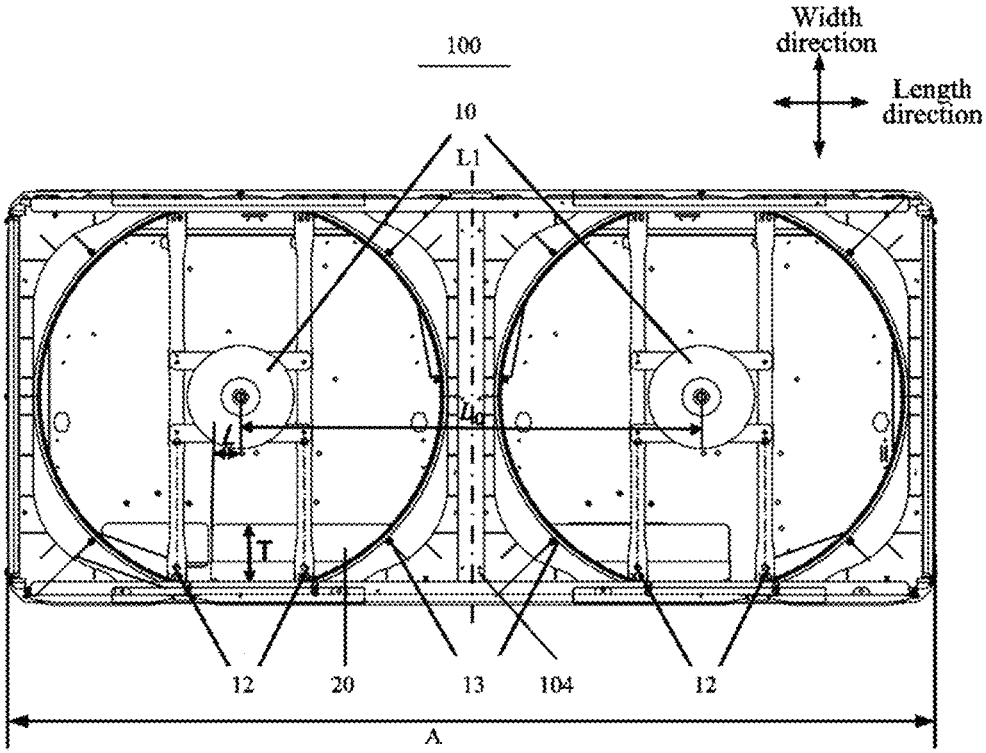
FIG. 6 is a schematic view showing a structure of an air conditioning outdoor unit according to an embodiment of the present disclosure.

As shown in FIGS. 6 and 11, in some embodiments, the air conditioning outdoor unit 100 includes two heat exchangers 30 disposed opposite to each other, and the two heat exchangers 30 cooperate to form a gap for receiving the electronic control box 20, to reduce interference between the electronic control box 20 and the heat exchangers 30.

Referring to FIGS. 6 and 11, in some embodiments, the air conditioning outdoor unit 100 may include two wind turbines 10, a wind guiding ring 13 is provided at the air outlet of each wind turbine, and $(W+\sqrt{R^2-(R-T)^2})-L_0 \leq L \leq \sqrt{R^2-(R-T)^2}$, where W is the width of the electronic control box 20, R is the inner diameter of the wind guiding ring 13 of the wind turbine 10, $L_0$ is the axial distance between the two wind turbines 10, T is the width dimension of the projection of the electronic control box 20 falling on the wind turbine 10 in the vertical direction, and L is the distance between one side of the electronic control box 20 to one side of the axial distance of the wind turbine 10 along the length direction of the air conditioning outdoor unit 100.

In the present embodiment, the part of the electronic control box 20 is located at the middle connection part of the two wind guiding rings 13 of the two wind turbines 10, and the middle connection part of the two wind guiding rings 13 is not located at the air channel of the air conditioning outdoor unit 100. The embodiment of the present application proposes that the wind guiding rings 13 are provided on the air outlet side of each wind turbine 10, and at least part of the electronic control box 20 is located below the two adjacent wind guiding rings 13, which can reduce the shielding of the air channel at the inlet of the wind turbine 10 by the electronic control box 20, facilitating the improvement of the air volume and controlling the interference noise. In addition, on the basis that the overall length of the air conditioning outdoor unit 100 is fixed, the embodiments of the present application actually indirectly define the length dimension of the electronic control box 20 by defining the distance along the length direction of the whole air conditioning outdoor unit 100 from one side of the electronic control box 20 to one side of the axial center of the wind turbine 10, to achieve the purpose of adjusting the air volume and noise by adjusting the size and position of the electronic control box 20.

In some embodiments, the electronic control box 20 is symmetrically distributed relative to the support beam 104, and the distance from one side of the electronic control box 20 along the length direction to the axial center of one side wind turbine is equal to the distance from the other side of the electronic control box 20 along the length direction to the axial center of the other side wind turbine, that is to say, on the basis that the overall length of the air conditioning outdoor unit 100 is fixed, the embodiment of the present application defines the distance from one side of the electronic control box 20 to the axial center of one side wind turbine 10 along the length direction of the whole air conditioning outdoor unit 100; and based on defining the distance from the other side of the electronic control box 20 to the axial center of the other side wind turbine 10 along the length direction of the whole air conditioning outdoor unit 100, the length dimension of the electronic control box 20 is actually indirectly defined, to achieve the purpose of adjusting the air volume of the wind turbine 10 and the noise of the wind turbine 10 by adjusting the size and position of the electronic control box 20.

In some embodiments, the wind guiding ring 13 and the gap between the wind turbine 10 and the case 110 are all arranged along the length direction of the case 110. The embodiment of the present application sets the electronic control box 20 as a rectangular structure, and sets the length direction of the electronic control box 20 along the length direction of the case 110, to reduce the influence of the electronic control box 20 on the ventilation of the interior of the case 110, and at the same time, the electronic control box 20 blocks the ventilation channel of the interior of the case 110 along the width direction. The embodiment of the present application proposes to minimize the width of the electronic control box 20, to reduce the influence of the electronic control box 20 on the wind volume and noise of the wind turbine 10.

In some embodiments, the embodiments of the present application do not define the relationship between the length and the height of the electronic control box 20. In the case where the size of the compressor 40 in the case 110 is large, the embodiments of the present application propose to distribute the length direction of the electronic control box 20 along the length direction of the case 110, and the length of the electronic control box 20 is greater than the height of the electronic control box 20, to reduce the interference between the electronic control box 20 and the compressor 40 in the case 110 by limiting the height of the electronic control box 20.

Figure 9:
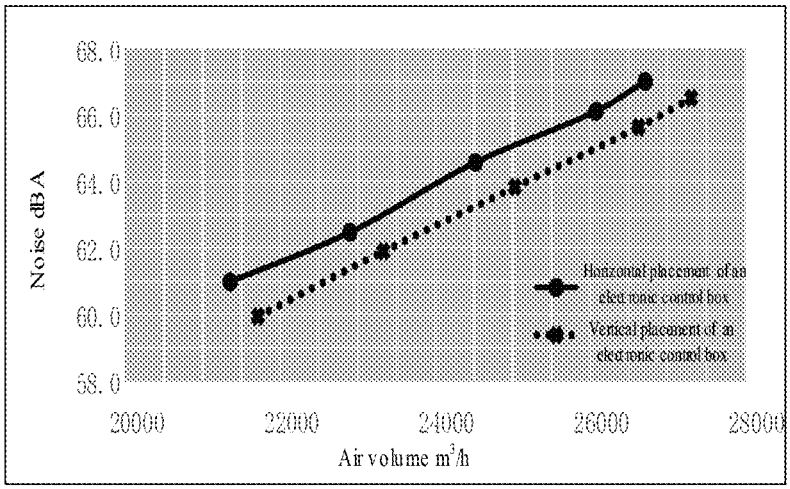
FIG. 9 is a coordinate diagram of noise-air volume for a horizontal/vertical placement of an electronic control box according to an embodiment of the present disclosure.

In some embodiments, in the case where the size of the compressor 40 in the case 110 is small, the internal space of the air conditioning outdoor unit 100 and the assembly allows, the vertical electronic control box 20 may be used, the electronic control box 20 is also provided in a rectangular structure, and the height direction of the electronic control box 20 is distributed along the height direction of the case 110, the height of the electronic control box 20 is greater than the length of the electronic control box 20, namely, the short side b of the electronic control box 20 is placed in a horizontal direction, and the long side a of the electronic control box 20 is placed along a vertical direction, so that the electronic control box 20 shields the inlet area of the wind turbine 10 to a minimum. As shown in FIG. 9, the horizontal electronic control box 20 is compared with the vertical discharge for a certain multi-line outdoor unit, and it can be seen therefrom that the noise of the wind turbine 10 can be minimized using the vertical electronic control box 20.

As shown in FIG. 9, for example, but not limited to when the air volume is 22000 $m^3/h$, the noise value of the electronic control box 20 horizontally is 61.6 dBA, the noise value of the electronic control box 20 vertically is 60.4 dBA, and the air volume is 23000 $m^3/h$, the noise value of the electronic control box 20 horizontally is 62.5 dBA, the noise value of the electronic control box 20 vertically is 61.5 dBA, and the air volume is 24000 $m^3/h$, the noise value of the electronic control box 20 horizontally is 64 dBA, the noise value of the electronic control box 20 vertically is 62.8 dBA, and the air volume is 25000 $m^3/h$; when the noise value of the electronic control box 20 placed horizontally is 65 dBA, the noise value of the electronic control box 20 placed vertically is 64 dBA, and when the air volume is 26000 $m^3/h$, the noise value of the electronic control box 20 placed horizontally is 66 dBA, and the noise value of the electronic control box 20 placed vertically is 65 dBA.

Second Embodiment

As shown in FIGS. 1, 4, 5, and 6, the present disclosure provides an air conditioning outdoor unit 100 including a case 110, a wind turbine 10, and an electronic control box 20, where the top of the case 110 is provided with an air outlet, the wind turbine 10 is arranged at the top of the case 110 and located at the air outlet, the electronic control box 20 is arranged at the case 110, and the width of the projection of the electronic control box 20 falling on the wind turbine 10 along a vertical direction is T, and $T \leq 0.15 \times D$, D being the diameter of the wind turbine 10.

For the air conditioning outdoor unit of the present disclosure, the embodiments of the present application propose to improve the airfield and noise inside the case 110 by adjusting the position of the electronic control box 20, and particularly, the present disclosure provides an outdoor unit for air conditioner 100 including a box body 111 and a panel 101. The box body 111 is opened with an opening (as shown in FIG. 1, the opening is located at the panel 101 on the right side of the case 110), and the panel 101 is movably connected to the opening to open or close the opening. For example, the panel 101 may be detachably coupled to the box body 111, or the panel 101 may be rotatably coupled to the box body 111. An air outlet is provided at the top of the box body 111.

The number of panels 101 may be one or more. A heat exchanger 30 is provided inside the case 110. An air outlet is provided at the top of the case 110. A fan module 1000 is provided at the position where the top of the case 110 is located at the air outlet, and a mesh cover 103 is provided at the air outlet side of the fan module 1000 at the top of the case 110.

The electronic control box 20 is provided in the case 110 at the opening, or the electronic control box 20 is provided at the side of the case 110 near the panel 101, and the electronic control box 20 may be mounted on a support plate (not shown) extending downward from the motor bracket 12. The opening of the case 110 can be opened by adjusting the position of the panel 101 to service the electronic control box 20.

The heat exchanger 30 is disposed inside the case 110 and is circumferentially disposed along an inner wall of the case 110. The heat exchanger 30 is provided with a gap. The gap corresponds to at least a portion of the opening of the box body 111. At least a portion of the electronic control box 20 is disposed in the gap (E is the length of the gap in FIG. 10). The shape of the heat exchanger 30 may be, for example, but not limited to, a C-type structure, a G-type structure, an L-type structure, or a U-type structure.

The fan module 1000 is used to create an airflow. The fan module 1000 may include a wind turbine 10, a motor 11, a motor bracket 12, and a wind guiding ring 13, the top plate of the electronic control box 20 is located below the motor bracket 12, and during the operation of the fan module 1000, air flows from the inside of the case 110 to the wind turbine 10 and flows out from an air outlet at the top. A mesh cover 103 may be provided at the air outlet.

It would be appreciated that both the heat exchanger 30 and the electronic control box 20 within the case 110 are located in the air flow path. The heat exchanger 30 serves to exchange heat with the air flow at the air duct, and the heat exchanger 30 is provided around the periphery of the case 110 with the air duct almost completely covering the inner space of the case 110. The electronic control box 20 is disposed in the inner space of the case 110, so that the electronic control box 20 blocks a part of the air path, resulting in a decrease in the air output of the air conditioning outdoor unit 100. At the same time, the presence of the electronic control box 20 interferes with the otherwise uniform airflow of the wind turbine 10, and the turbulent airflow of the wind turbine 10 creates additional aerodynamic noise.

In the case where the wind guiding ring 13 is provided on the air outlet side of the wind turbine 10, the wind guiding ring 13 is not located in the air channel of the wind turbine 10, and by limiting the width of the electronic control box 20, most of the electronic control box 20 can be located below the wind guiding ring 13, so that the shielding of the air channel and the inlet of the wind turbine 10 by the electronic control box 20 can be reduced, which is beneficial to the improvement of the air volume and the control of interference noise.

In some embodiments, as shown in FIGS. 1, 2, and 6, at least a portion of the electronic control box 20 is located inside the case 110.

A wind guiding ring 13 is provided between the wind turbine 10 and the case 110 of the air conditioning outdoor unit 100, and the width of the projection of the electronic control box 20 falling on the wind turbine 10 in the vertical direction in the embodiment of the present application includes the width of at least a part of the electronic control box 20 located inside the case 110 minus the thickness of the wind guiding ring 13, namely, in the case where the air outlet side of the wind turbine 10 is provided with the wind guiding ring 13, the electronic control box 20 is located below the wind guiding ring 13, and $T=T1-T2$; T1 is the width of the part of the electronic control box 20 located inside the case 110, and T2 is the thickness of the wind guiding ring 13.

The embodiment of the present application indirectly defines the width dimension of the electronic control box 20 based on defining the projection dimension of the part of the electronic control box 20 located inside the case 110 on the wind turbine 10, to achieve the purpose of adjusting the wind volume and noise by adjusting the size and position of the electronic control box 20.

D has a range of values from 500 mm to 920 mm, such as, but not limited to, the following five, when D=500 mm, $T \leq 75$, when D=600 mm, $T \leq 90$ mm, when D=700 mm, $T \leq 105$ mm, when D=800 mm, $T \leq 120$ mm, when D=920 mm, $T \leq 138$ mm.

In some embodiments, the width of the projection of the electronic control box 20 falling on the wind turbine 10 in the vertical direction is $T \leq 0.1 \times D$, and the lower limit of the value range of T is determined according to the actual design requirements of the electronic control box 20; the presence of the electronic control box 20 blocks the air inlet of the wind turbine 10, and at the same time reducing the amount of air inlet, also causes the phenomenon of uneven air inlet of the wind turbine 10; and the embodiment of the present application is one of the effective methods for reducing the influence of the electronic control box 20 on the inlet flow field of the wind turbine 10 by reducing the width of the electronic control box 20. As shown in FIG. 8, through experiments, in the case $T/D \leq 0.15$, the influence of the electronic control box 20 on the flow field and noise at the inlet of the wind turbine 10 is minimal, the noise at the inlet of the wind turbine 10 can be reduced below 61.58, for example, but not limited to the following five types: when T/D=0.1, the noise value is 61.4 dBA; when T/D=0.08, the noise value is 61.4 dBA; when T/D=0.06, the noise value is 61.3 dBA; when=0.04, the noise value is 61.2 dBA; and when T/D=0.02, the noise value is 61.1 dBA.

As shown in FIGS. 6, 11 and 12, the air conditioning outdoor unit includes a case 110, an air outlet is provided at the top of the case 110, at least two wind turbines 10 are arranged at the air outlet, an electronic control box 20 is arranged at the case 110 and crosses two adjacent wind turbines 10 and is located below the wind turbines 10, and the projected area of the electronic control box 20 on the wind turbines 10 in the vertical direction is S, then $0.5(2\times S1+S2)\leq S\leq(2\times S1+S2)$, where $$S1 = R\cdot T\cdot \sin(a) - \frac{(A-\sin(a))R^{\wedge}2 + TR\sin(a)}{2},$$

$S2=T\cdot(L_0-2R)$, R is the radius of the wind guiding ring 13 of the wind turbines 10, T is the width of the projection of the electronic control box 20 falling on the wind turbine 10 in the vertical direction, a=arccos (R−T/R) with a unit of degree, and $A=a\cdot\pi/180$, and $L_0$ is the axial distance between two adjacent wind turbines 10.

In the present embodiment, by defining the projected area S of the electronic control box 20 on the wind turbine 10 in the vertical direction, it is possible to directly define the shielding of the two air passages of the two wind turbines 10 by the electronic control box 20 at the same time, to achieve the purpose of reasonably controlling the overall ventilation effect of the air conditioning outdoor unit 100, reducing the phenomenon that the air outlet volume of one side of the air conditioning outdoor unit 100 is large and the air outlet volume of the other side is small, and achieving the effect that the two sides can uniformly outlet air.

Referring to FIG. 6, in some embodiments, the width of the projection of the electronic control box 20 onto at least two wind turbines 10 along a vertical direction is $T, T\leq 0.15\times D$, and D is the diameter of the wind turbine 10.

The embodiment of the present application proposes to improve the airfield and noise inside the case 110 by adjusting the position of the electronic control box 20, specifically, in the case where the wind guiding ring 13 is provided on the air outlet side of the wind turbine 10, the wind guiding ring 13 is not located in the air channel of the wind turbine 10, and by limiting the projection width of the electronic control box 20, the majority of the electronic control box 20 can be located below the wind guiding ring 13, and the shielding of the air inlet and the air channel of the wind turbine 10 by the electronic control box 20 can be reduced, facilitating the improvement of the air volume and controlling the interference noise.

As shown in FIG. 12, in some embodiments, the air conditioning outdoor unit 100 may be provided with only one U-shaped heat exchanger and one U-shaped heat exchanger is provided around the inner wall of the case 110.

In some embodiments, the case 110 is a rectangular structure, the air outlet at the top of the case 110 is a rectangular structure or a circular structure, the electronic control box 20 is a rectangular structure, and the wind guiding ring 13 is of a circular structure. By arranging the electronic control box 20 inside the case 110, the electronic control box 20 can be located at the corner between the wind guiding ring 13 and the case 110, to minimize the interference of the electronic control box 20 on the air passage and improving the ventilation performance and noise reduction capability of the wind turbine 10.

As shown in FIG. 1, in some embodiments, the distance between the top of the electronic control box 20 and the bottom of the wind turbine 10 is $Z_1$, $0.1\times D\leq Z_1\leq 0.2\times D$, where D is the diameter of the wind turbine 10.

The air conditioning outdoor unit 100 of the present disclosure reduces the adverse effect of the electronic control box 20 on the air conditioning outdoor unit 100 and reduces the air volume loss and the noise caused by the electronic control box 20 by rationally arranging the distance between the electronic control box 20 and the wind turbine 10 on the premise of ensuring the normal operation and convenient maintenance of the air conditioning outdoor unit 100. The distance between the top of the electronic control box 20 to the bottom of the wind turbine 10 described in the embodiments of the present disclosure is the minimum distance of the vertical distance between the top of the electronic control box 20 to the bottom of the wind turbine 10.

In order to reduce the influence of the electronic control box 20 on the air field and noise around the wind turbine 10, the embodiment of the present application proposes that the air field and noise inside the case 110 can be improved by adjusting the position of the electronic control box 20, in particular, the distance $Z_1$ between the top of the electronic control box 20 and the bottom of the wind turbine 10 and the diameter D of the wind turbine 10 can effectively improve the influence of the electronic control box 20 on the air volume and noise inside the case 110 under the satisfied conditions $0.1\times D\leq Z_1\leq 0.2\times D$. In particular, by increasing the axial spacing between the electronic control box 20 and the wind turbine 10 (in the height direction as shown in FIG. 2), the effect of the electronic control box 20 on the flow field at the inlet of the wind turbine 10 can be reduced, and within the above-mentioned distance range, in particular within the range $0.14\times D\leq Z_1\leq 0.16\times D$, the effect of the electronic control box 20 on the wind turbine 10 is small, facilitating the generation of a higher air volume and noise control. As shown in FIG. 7, the ratio of the noise value to the air volume in the case 110 can be minimized in a case $0.1\leq Z_1/D\leq 0.16$, where the range of the ratio of the noise value to the air volume in the case 110 is between 5.08 and 5.2, for example, but not limited to the following five types: when $Z_1/D=0.1$, the ratio of the noise value to the air volume is 5.2; when $Z_1/D=0.12$, the ratio of the noise value to the air volume is 5.12; when $Z_1/D=0.13$, the ratio of the noise value to the air volume is 5.09; when $Z_1/D=0.14$, the ratio of the noise value to the air volume is 5.07; and when $Z_1/D=0.16$, the ratio of the noise value to the air volume is 5.09.

As shown in FIG. 1, in some embodiments, the bottom of the case 110 is also provided with a compressor assembly, and embodiments of the present disclosure propose setting the distance between the bottom of the electronic control box 20 to the bottom of the case 110 to be $Z_2$, $Z_2\geq 0.8\times h$, where h is the height of the compressor assembly within the case 110, to ensure assembly and maintenance feasibility.

In the present embodiment, the bottom of the case 110 is provided with the baseplate 102, and the distance between the bottom of the electronic control box 20 and the baseplate 102 satisfies $Z_2$, and the embodiment of the present disclosure sets the $Z_2$ value range large enough to reduce the influence of the $Z_2$ value on the $Z_1$ value, that is, to satisfy the influence on the $Z_2$ value based on the satisfied $Z_1$ value. At the same time, by defining the $Z_1$ value and the $Z_2$ value, it is also possible to define the overall height of the electronic control box 20, that is to say, the embodiment of the present application actually indirectly defines the height dimension of the electronic control box 20 based on defining the top position and the bottom position of the electronic control box 20, to achieve the purpose of adjusting the air volume and noise by adjusting the size and position of the electronic control box 20.

The compressor assembly includes a compressor 40 and a mounting support, where the mounting support is provided on a baseplate 102 of a box body 111, the compressor 40 is mounted on the baseplate 102 of the box body 111 via the mounting support, and the height of the compressor assembly includes the height of the compressor 40 and the height of the mounting support.

Alternatively, a support beam 104 is provided in the middle of the case 110, at least part of the electronic control box 20 is located below the support beam 104, and the support beam 104 is not located in the air channel of the air conditioning outdoor unit 100. The embodiment of the present application proposes that at least part of the electronic control box 20 is located below the support beam 104 between two adjacent wind turbines, to reduce the shielding of the wind channel at the inlet of the wind turbines 10 by the electronic control box 20, facilitating the improvement of the air volume and controlling interference noise. The support beam 104 of the present application does not define a shape. A structure located at the middle part of the top of the case 110 and connecting two sides of the top of the case 110 for increasing the strength of the top of the case 110 can be understood as a support beam 104.

As shown in FIGS. 1, 3 and 10, in some embodiments, the air conditioning outdoor unit 100 includes a heat exchanger 30. The heat exchanger 30 forms a gap for receiving the electronic control box 20. The length of the electronic control box 20 is a, $0.5\times A\leq a\leq K$; A is the entire length of the air conditioning outdoor unit 100, and E is the length of the gap, K being a smaller value between $0.95\times E$ and $0.9\times A$.

In the present embodiment, by setting the length of the electronic control box 20 to a, and $0.5\times A\leq a\leq K$; it is possible to reduce the interference of the electronic control box 20 with the air conditioning outdoor unit 100 and the heat exchanger 30 while allowing for sufficient electric components to be installed inside the electronic control box 20.

A wind guiding ring 13 is provided between the wind turbine 10 of the air conditioning outdoor unit 100 and the machine case 110; the air channel located inside the machine case 110 does not include the wind guiding ring 13; the part of the electronic control box 20 along the length direction has less influence on the air channel; and the embodiment of the present application proposes to set the length of the electronic control box 20 to a larger size range to make up for the size limitation of the electronic control box 20 in the width direction.

In some embodiments, the heat exchanger 30 of the air conditioning outdoor unit 100 is circumferentially disposed along the inner sidewall of the case 110 and is provided with a gap (the length E of the gap is shown in FIG. 10) for installing the electronic control box 20.

In the present embodiment, the shape of the heat exchanger 30 can be, for example, but is not limited to, a C-shaped structure, a G-shaped structure, an L-shaped structure or a U-shaped structure; the C-shaped heat exchanger is arranged around three sides of the case 110, so that the ventilation channel inside the case 110 is also distributed around the inner space of the case 110; the gap of the C-shaped heat exchanger is used for mounting the electronic control box 20, to reduce the influence of the electronic control box 20 on the airflow after the heat exchange is completed; and at the same time, arranging the electronic control box 20 at the gap of the C-shaped heat exchanger can also reduce the interference between the electronic control box 20 and the C-shaped heat exchanger. Assembly and maintenance replacement of the electronic control box 20 and the type C heat exchanger is facilitated.

As shown in FIGS. 6, 3 and 11, in some embodiments, the air conditioning outdoor unit 100 includes two heat exchangers 30 oppositely disposed in the length direction, and the length of the electronic control box 20 is a, $0.32\times A\leq a\leq K$, where A is the entire length of the air conditioning outdoor unit 100, and F is the length of the gap (F in FIG. 11), K being a smaller value between $0.95\times F$ and $0.9\times A$.

The embodiment of the present application proposes that two adjacent heat exchangers 30 cooperate to form a gap for mounting the electronic control box 20, to reduce interference between the electronic control box 20 and the heat exchangers 30 during the process of crossing the air conditioning outdoor unit 100, and reducing the influence of the electronic control box 20 on the air volume and noise in the case 110 by defining the length a of the electronic control box 20.

Referring to FIGS. 6 and 11, in some embodiments, the air conditioning outdoor unit 100 may include two wind turbines 10, one wind guiding ring 13 is provided at the air outlet of each wind turbine, and $(W+\sqrt{R^2-(R-T)^2})-L_0\leq L\leq\sqrt{R^2-(R-T)^2}$, where W is the width of the electronic control box 20, R is the inner diameter of the wind guiding ring 13 of the wind turbine 10, $L_0$ is the axial distance between the two wind turbines 10, T is the width of the projection of the electronic control box 20 falling on the wind turbine 10 in the vertical direction, and L is the distance between one side of the electronic control box 20 to one side of the axial distance of the wind turbine 10 along the length direction of the air conditioning outdoor unit 100.

In the present embodiment, the part of the electronic control box 20 is located at the middle connection part of the two wind guiding rings 13 corresponding to the two wind turbines 10, and the middle connection part of the two wind guiding rings 13 is not located at the air channel of the air conditioning outdoor unit 100. The embodiment of the present application proposes that the air outlet side of each wind turbine 10 is provided with one wind guiding ring 13, and at least part of the electronic control box 20 is located below the two adjacent wind guiding rings 13, which can reduce the shielding of the air channel at the inlet of the wind turbine 10 by the electronic control box 20, facilitating the increase of the air volume and controlling the interference noise. In addition, on the basis that the overall length of the air conditioning outdoor unit 100 is fixed, the embodiments of the present application actually indirectly define the length dimension of the electronic control box 20 by defining the distance along the length direction of the whole air conditioning outdoor unit 100 from one side of the electronic control box 20 to one side of the axial center of the wind turbine 10, to achieve the purpose of adjusting the air volume and noise by adjusting the size and position of the electronic control box 20.

In some embodiments, the embodiments of the present application also provide that the electronic control box 20 is symmetrically distributed concerning the central axis of the vertical direction of the case, or symmetrically distributed concerning the support beam 104, and the distance from one side of the electronic control box 20 along the length direction to one side of the wind turbine axis is equal to the distance from the other side of the electronic control box 20 along the length direction to the other side of the wind turbine axis, that is to say, on the basis that the overall length of the air conditioning outdoor unit 100 is fixed. In the embodiments of the present application, based on defining the distance from one side of the electronic control box 20 to the axial center of one side of the wind turbine 10 along the entire length direction of the air conditioning outdoor unit 100 and defining the distance from the other side of the electronic control box 20 to the axial center of the other side of the wind turbine 10 along the entire length direction of the air conditioning outdoor unit 100, the length dimension of the electronic control box 20 is also indirectly defined, to achieve the purpose of adjusting the air volume of the wind turbine 10 and the noise of the wind turbine 10 by adjusting the size and position of the electronic control box 20.

In some embodiments, the electronic control box 20 is a closed electronic control box, to reduce wind within the case 110 from entering the interior of the electronic control box 20 and reducing the noise contribution of the electronic control box 20 to the airflow of the case 110.

In some embodiments, the embodiment of the present application sets the electronic control box 20 as a rectangular structure, and sets the length direction of the electronic control box 20 along the length direction of the machine case 110, to reduce the influence of the electronic control box 20 on the ventilation inside the machine case 110, and at the same time, the electronic control box 20 blocks the ventilation channel inside the machine case 110 in the width direction, and the embodiment of the present application proposes to minimize the width of the electronic control box 20, to reduce the influence of the electronic control box 20 on the wind volume and noise of the wind turbine 10.

In some embodiments, the embodiments of the present application do not define the relationship between the length and the height of the electronic control box 20. In the case where the size of the compressor 40 in the case 110 is large, the embodiments of the present application propose to distribute the length direction of the electronic control box 20 along the length direction of the case 110, and the length of the electronic control box 20 is greater than the height of the electronic control box 20, to reduce the interference between the electronic control box 20 and the compressor 40 in the case 110 by limiting the height of the electronic control box 20.

In some embodiments, in the case where the size of the compressor 40 in the case 110 is small, and the internal space of the air conditioning outdoor unit 100 and the assembly allows, the vertical electronic control box 20 may be used, the electronic control box 20 is also provided in a rectangular structure, and the height direction of the electronic control box 20 is distributed along the height direction of the case 110, the height of the electronic control box 20 is greater than the length of the electronic control box 20, namely, the short side b of the electronic control box 20 is placed in a horizontal direction, and the long side a of the electronic control box 20 is placed along a vertical direction, so that the electronic control box 20 shields the inlet area of the wind turbine 10 to a minimum. As shown in FIG. 9, the horizontal electronic control box 20 is compared with the vertical discharge for a certain multi-line outdoor unit, and it can be seen therefrom that the noise of the wind turbine 10 can be minimized by means of the vertical electronic control box 20.

As shown in FIG. 9, for example, but not limited to the following five kinds: when the air volume is 22000 $m^3$/h, the noise value of the electronic control box 20 horizontally is 61.6 dBA, the noise value of the electronic control box 20 vertically is 60.4 dBA, and the air volume is 23000 $m^3$/h, the noise value of the electronic control box 20 horizontally is 62.5 dBA, the noise value of the electronic control box 20 vertically is 61.5 dBA, and the air volume is 24000 $m^3$/h, the noise value of the electronic control box 20 horizontally is 64 dBA, the noise value of the electronic control box 20 vertically is 62.8 dBA, and the air volume is 25000 $m^3$/h; when the noise value of the electronic control box 20 placed horizontally is 65 dBA, the noise value of the electronic control box 20 placed vertically is 64 dBA, and when the air volume is 26000 $m^3$/h, the noise value of the electronic control box 20 placed horizontally is 66 dBA, and the noise value of the electronic control box 20 placed vertically is 65 dBA.

Third Embodiment

As shown in FIGS. 1 to 3, the present disclosure provides an air conditioning outdoor unit 100 including a case 110, a wind turbine 10 and an electronic control box 20, where the top of the case 110 is provided with an air outlet, the wind turbine 10 is arranged at the top of the case 110 and at the position of the air outlet, and the electronic control box 20 is arranged at the case 110, and $0.1\times D\leq Z_1\leq 0.2\times D$, where D is the diameter of the wind turbine 10, and $Z_1$ is the distance from the top of the electronic control box 20 to the bottom of the wind turbine 10.

The air conditioning outdoor unit 100 of the present disclosure reduces the adverse effect of the electronic control box 20 on the air conditioning outdoor unit 100 and reduces the air volume loss and the noise caused by the electronic control box 20 by rationally arranging the distance between the electronic control box 20 and the wind turbine 10 on the premise of ensuring the normal operation and convenient maintenance of the air conditioning outdoor unit 100.

It is to be understood that the present embodiment does not limit the number of the wind turbines, and the number of the wind turbines may be one, two, or any other number. This embodiment also does not limit the number of heat exchangers, and the number of heat exchangers may be one or more.

As shown in FIG. 7, through experiments, the ratio of the noise value to the air volume in the case 110 can be effectively reduced under satisfied $0.1\times D\leq Z_1\leq 0.2\times D$, and the loss of air volume and the noise caused by the electronic control box 20 can be reduced. As can be seen from FIG. 7 that the ratio of the noise value to the air volume in the case 110 can be minimized under $0.1\leq Z_1/D\leq 0.16$, and the ratio of the noise value to the air volume in the case 110 ranges between 5.08 and 5.2.

D has a range of values from 500 mm to 920 mm and may be, for example but not limited to: when D=500 mm, 50 mm$\leq Z_1\leq$100 m, when D=600 mm, 60 mm$\leq Z_1\leq$120 mm, when D=700 mm, 70 mm$\leq Z_1\leq$140 mm, when D=800 mm, 80 mm$\leq Z_1\leq$160 mm, when D=920 mm, 92 mm$\leq Z_1\leq$184 mm.

Alternatively, the distance from the top of the electronic control box 20 to the bottom of the wind turbine 10 described in the embodiments of the present disclosure is the minimum distance from the vertical distance from the top of the electronic control box 20 to the bottom of the wind turbine 10.

The present disclosure provides an air conditioning outdoor unit 100 including a case 110, an electronic control box 20, a heat exchanger 30, and a fan module 1000.

As shown in FIGS. 1 and 2, the case 110 includes a box body 111 and a panel 101. The box body 111 is opened with an opening (as shown in FIG. 1, the opening is located at the panel 101 on the right side of the case 110), and the panel 101 is movably connected to the opening to open or close the opening. For example, the panel 101 may be detachably coupled to the box body 111, or the panel 101 may be rotatably coupled to the box body 111. An air outlet is provided at the top of the box body 111.

The number of panels 101 may be one or more. A heat exchanger 30 is provided inside the case 110. An air outlet is provided at the top of the case 110. A fan module 1000 is provided at the top of the case 110 at the position of the air outlet. A mesh cover 103 is provided at the top of the case 110 on the air outlet side of the fan module 1000.

The electronic control box 20 is disposed in the case 110 at the opening, or the electronic control box 20 is disposed at one side of the case 110 near the panel 101, and the electronic control box 20 may be mounted on a support frame, both ends of which are mounted on two side plates of the box body 111 adjacent to the panel 101, or to a suspension bar extending downward of the motor bracket 12. The opening of the case 110 can be opened by adjusting the position of the panel 101 to service the electronic control box 20.

The heat exchanger 30 is disposed inside the case 110 and is circumferentially disposed along an inner wall of the case 110. The heat exchanger 30 is provided with a gap. The gap corresponds to at least a portion of the opening of the box body 111. At least a portion of the electronic control box 20 is disposed in the gap (E is the length of the gap in FIG. 10). The shape of the heat exchanger 30 may be, for example, but not limited to, a C-type structure, a G-type structure, an L-type structure, or a U-type structure.

The fan module 1000 is used to create an airflow. The fan module 1000 may include a wind turbine 10, a motor 11, a motor bracket 12 and a wind guiding ring 13, the top plate of the electronic control box 20 is located below the motor bracket 12, and during the operation of the fan module 1000, air flows from the inside of the case 110 to the wind turbine 10 and flows out from an air outlet at the top. A mesh cover 103 may be provided at the air outlet.

It will be appreciated that both the heat exchanger 30 and the electronic control box 20 within the case 110 are located in the air flow path. The heat exchanger 30 is disposed around the periphery of the case 110, and the air path almost completely covers the inner space of the case 110. The electronic control box 20 is disposed in the inner space of the case 110, so that the electronic control box 20 blocks a part of the air path, resulting in a decrease in the air output of the air conditioning outdoor unit 100. At the same time, the presence of the electronic control box 20 interferes with the otherwise uniform airflow of the wind turbine 10, and the turbulent airflow of the wind turbine 10 creates additional aerodynamic noise.

To reduce the influence of the electronic control box 20 on the airfield and noise around the wind turbine 10, embodiments of the present application propose to improve the airfield and noise inside the case 110 by adjusting the position of the electronic control box 20.

Referring to FIGS. 1 to 3, a distance $Z_1$ from the top of the electronic control box 20 to the bottom of the wind turbine 10 and a diameter D of the wind turbine 10 are sufficient to effectively improve the influence of the electronic control box 20 on the amount of wind and noise in the case 110 under $0.1\times D\leq Z_1\leq 0.2\times D$. In one embodiment, increasing the axial spacing between the electronic control box 20 and the wind turbine 10 (height direction as shown in FIG. 2) can reduce the effect of the electronic control box 20 on the air inlet flow field of the wind turbine 10.

In an embodiment, $0.14\times D\leq Z_1\leq 0.16\times D$ is satisfied. In this way, the electronic control box 20 has a small influence on the wind turbine 10, facilitating the generation of a higher air volume and noise control. As shown in FIG. 7, under the condition that $0.1\leq Z_1/D\leq 0.16$ is satisfied, the ratio of the noise value to the air volume in the case 110 can be minimized, and at this time, the ratio range of the noise value to the air volume in the case 110 is between 5.08 and 5.2, for example, but not limited to: when $Z_1/D=0.1$, the ratio of noise value to air volume is 5.2, when $Z_1/D=0.12$, the ratio of noise value to air volume is 5.12, when $Z_1/D=0.13$, the ratio of noise value to air volume is 5.09, when $Z_1/D=0.14$, the ratio of noise value to air volume is 5.07, and when $Z_1/D=0.16$, the ratio of noise value to air volume is 5.09.

As shown in FIG. 1, in some embodiments, the bottom of the case 110 is also provided with a compressor assembly, and embodiments of the present disclosure propose setting the distance between the bottom of the electronic control box 20 to the bottom of the case 110 to be $Z_2$, $Z_2\geq 0.8\times h$, where h is the height of the compressor assembly within the case 110, to ensure assembly and maintenance feasibility.

In the present embodiment, the bottom of the case 110 is provided with the baseplate 102, and the distance between the bottom of the electronic control box 20 and the baseplate 102 satisfies the $Z_2$ range value, and the embodiment of the present disclosure sets the $Z_2$ range value large enough to reduce the influence of the $Z_2$ value on the Z value, that is, to satisfy the influence on the $Z_2$ value based on the satisfied $Z_1$ value. At the same time, by defining the $Z_1$ value and the $Z_2$ value, it is also possible to define the overall height of the electronic control box 20, that is to say, the embodiment of the present application actually indirectly defines the height dimension of the electronic control box 20 based on defining the top position and the bottom position of the electronic control box 20, to achieve the purpose of adjusting the air volume and noise by adjusting the size and position of the electronic control box 20.

The compressor assembly includes a compressor 40 and a mounting support, where the mounting support is provided on the baseplate 102 of the box body 111, the compressor 40 is mounted on the baseplate 102 of the box body 111 via the mounting support, and the height of the compressor assembly protects the height of the compressor 40 and the height of the mounting support.

As shown in FIGS. 4 and 5, in some embodiments, to reduce the obstruction of the ventilation duct by the electronic control box 20, the embodiment of the present disclosure also proposes that the projection dimension of the electronic control box 20 on the wind turbine 10 in the vertical direction has a width dimension T in the width direction, T satisfying $T\leq 0.15\times D$.

In this embodiment, the width T of the projection of the electronic control box 20 on the wind turbine 10 in the vertical direction is the projection size of the part of the electronic control box 20 located in the inner space of the case 110 on the wind turbine 10.

As shown in FIG. 1, a wind guiding ring 13 is provided between the wind turbine 10 and the side wall of the box body 111 of the air conditioning outdoor unit 100, and the projection size of the portion of the electronic control box 20 located inside the case 110 described in the embodiment of the present application on the wind turbine 10 includes the width T1 of the portion of the electronic control box 20 located inside the case 110 minus the thickness T2 of the wind guiding ring 13.

In addition, the embodiment of the present application indirectly defines the width dimension of the electronic control box 20 based on defining the projection dimension of the part of the electronic control box 20 located inside the case 110 on the wind turbine 10, to achieve the purpose of adjusting the wind volume and noise by adjusting the size and position of the electronic control box 20.

Furthermore, the width of the projection of the electronic control box 20 on the wind turbine 10 along the vertical direction is $T \leq 0.1 \times D$, and the lower limit of the value range of T is determined according to the actual design requirements of the electronic control box 20; the presence of the electronic control box 20 blocks the air inlet of the wind turbine 10, and at the same time reducing the amount of air inlet, also causes the phenomenon of uneven air inlet of the wind turbine 10; and the embodiment of the present application is one of the effective methods for reducing the influence of the electronic control box 20 on the inlet flow field of the wind turbine 10 by reducing the width of the electronic control box 20. As shown in FIG. 8, through experiments, in the case $T/D \leq 0.15$, the influence of the electronic control box 20 on the flow field and noise at the inlet of the wind turbine 10 is minimal, the noise at the inlet of the wind turbine 10 can be reduced to 61.58 or less, for example, but not limited to: when T/D=0.1, the noise value is 61.4 dBA, when T/D=0.08, the noise value is 61.4 dBA, when T/D=0.06, the noise value is 61.3 dBA, when T/D=0.04, the noise value is 61.2 dBA, when=T/D=0.02, the noise value is 61.1 dBA.

Alternatively, a support beam 104 is provided in the middle of the case 110, at least part of the electronic control box 20 is located below the support beam 104, and the support beam 104 is not located in the air channel of the air conditioning outdoor unit 100. The embodiment of the present application proposes that at least part of the electronic control box 20 is located below the support beam 104 between two adjacent wind turbines 10, to reduce the shielding of the wind channel at the inlet of the wind turbines 10 by the electronic control box 20, facilitating the improvement of the air volume and controlling interference noise. The support beam 104 of the present application does not define a shape. A structure located at the middle part of the top of the case 110 and connecting two sides of the top of the case 110 for increasing the strength of the top of the case 110 can be understood as a support beam 104.

As shown in FIG. 1, FIG. 3 and FIG. 10, according to some embodiments of the present disclosure, the air conditioning outdoor unit 100 includes a heat exchanger 30, the length of the electronic control box 20 is a, $0.5 \times A \leq a \leq K$; A is the length of the whole unit of the air conditioning outdoor unit 100, E is the length of the gap (as shown in FIG. 10 or FIG. 12), and K is a smaller value between $0.95 \times E$ and $0.9 \times A$.

In the present embodiment, by setting the length of the electronic control box 20 to a, and $0.5 \times A \leq a \leq K$, it is possible to reduce the interference of the electronic control box 20 with the air conditioning outdoor unit 100 and the heat exchanger 30 while allowing for sufficient electronic components to be installed inside the electronic control box 20. Furthermore, since the wind guiding ring 13 and the blade tip clearance are provided between the wind turbine 10 and the case 110 of the air conditioning outdoor unit 100, the part of the electronic control box 20 along the length direction has less influence on the ventilation channel, the embodiments of the present application propose to set the length of the electronic control box 20 to a larger size range to meet the size limit of the electronic control box 20 in the width direction.

In some embodiments, the heat exchanger 30 of the air conditioning outdoor unit 100 is circumferentially disposed along the inner sidewall of the case 110 and provided with a gap (the length E of the gap is shown in FIG. 10) for disposing the electronic control box 20.

In the present embodiment, the shape of the heat exchanger 30 can be, for example, but is not limited to, a C-shaped structure, a G-shaped structure, an L-shaped structure or a U-shaped structure; the C-shaped heat exchanger is arranged around three sides of the case 110, so that the ventilation channel inside the case 110 is also distributed around the inner space of the case 110; the gap of the C-shaped heat exchanger is used for mounting the electronic control box 20, to reduce the influence of the electronic control box 20 on the airflow after the heat exchange is completed; and at the same time, arranging the electronic control box 20 at the gap of the C-shaped heat exchanger can also reduce the interference between the electronic control box 20 and the C-shaped heat exchanger. Assembly and maintenance replacement of the electronic control box 20 and the type C heat exchanger is facilitated.

As shown in FIGS. 6, 11, and 12, in some embodiments, the air conditioning outdoor unit 100 includes two heat exchangers 30 oppositely arranged in the length direction, the two heat exchangers 30 cooperating to form a gap, and the length of the electronic control box 20 is a, and $0.32 \times A \leq a \leq K$, where A is the whole length of the air conditioning outdoor unit 100, F is the length of the gap (as shown in FIG. 12), and K is a smaller value between $0.95 \times F$ and $0.9 \times A$.

The embodiment of the present application proposes that two adjacent heat exchangers 30 cooperate to form a gap for mounting the electronic control box 20, to reduce interference between the electronic control box 20 and the heat exchangers 30 during the process of crossing the air conditioning outdoor unit 100, and reducing the influence of the electronic control box 20 on the air volume and noise in the case 110 by defining the length a of the electronic control box 20.

As shown in FIG. 12, in some embodiments, the air conditioning outdoor unit 100 may be further provided with a U-type heat exchanger or a G-type heat exchanger, which is disposed around the inner wall of the case 110.

In some embodiments, the case 110 is a rectangular structure, the air outlet at the top of the case 110 is a rectangular structure or a circular structure, and the wind guiding ring 13 can be a circular structure. By arranging the electronic control box 20 inside the case 110, the electronic control box 20 can be located at the corner between the wind guiding ring 13 and the case 110, to minimize the interference of the electronic control box 20 on the air passage and improving the ventilation performance and noise reduction capability of the wind turbine 10.

As shown in FIG. 6, in some embodiments, the air conditioning outdoor unit 100 satisfies $(W+\sqrt{R^2-(R-T)^2})-L_0 \leq L \leq \sqrt{R^2-(R-T)^2}$, where W is the width of the electronic control box 20, R is the inner diameter of the wind guiding ring 13 of the wind turbine 10, $L_0$ is the axial distance between the two wind turbines 10, T is the dimension of the electronic control box 20 projected in the width direction on the wind turbine 10 in the vertical direction, and L is the distance between one side of the electronic control box 20 to one side of the axial distance of the wind turbine 10 in the length direction of the air conditioning outdoor unit 100.

In the present embodiment, the part of the electronic control box 20 is located at the middle connection part of the two wind guiding rings 13 of the two wind turbines 10, and the middle connection part of the two wind guiding rings 13 is not located at the air channel of the air conditioning outdoor unit 100; and the embodiment of the present application proposes that the air outlet of each wind turbine 10 is provided with one wind guiding ring 13, and at least part of the electronic control box 20 is located below the two adjacent wind guiding rings 13, which can reduce the shielding of the air channel at the inlet of the wind turbine 10 by the electronic control box 20, facilitating the increase of the air volume and controlling the interference noise. In addition, on the basis that the overall length of the air conditioning outdoor unit 100 is fixed, the embodiments of the present application actually indirectly define the length dimension of the electronic control box 20 by defining the distance along the length direction of the whole air conditioning outdoor unit 100 from one side of the electronic control box 20 to one side of the axial center of the wind turbine 10, to achieve the purpose of adjusting the air volume and noise by adjusting the size and position of the electronic control box 20.

In some embodiments, the electronic control box 20 is distributed symmetrically about a vertical central axis of the case, or alternatively, the electronic control box 20 is distributed symmetrically about the support beam 104. The distance from one side of the electronic control box 20 along the length direction to the axial center of one side wind turbine is equal to the distance from the other side of the electronic control box 20 along the length direction to the axial center of the other side wind turbine, that is to say, on the basis that the overall length of the air conditioning outdoor unit 100 is fixed, the embodiment of the present application defines the distance from one side of the electronic control box 20 to the axial center of one side wind turbine 10 along the length direction of the whole air conditioning outdoor unit 100, and defines the distance from the other side of the electronic control box 20 to the axial center of the other side wind turbine 10 along the length direction of the whole air conditioning outdoor unit 100; in fact, the length dimension of the electronic control box 20 is also indirectly defined, to achieve the purpose of adjusting the air volume of the wind turbine 10 and the noise of the wind turbine 10 by adjusting the size and position of the electronic control box 20.

In some embodiments, the embodiment of the present application sets the electronic control box 20 as a rectangular structure, and sets the length direction of the electronic control box 20 along the length direction of the machine case 110, to reduce the influence of the electronic control box 20 on the ventilation inside the machine case 110, and at the same time, the electronic control box 20 blocks the ventilation channel inside the machine case 110 in the width direction, and the embodiment of the present application proposes to minimize the width of the electronic control box 20, to reduce the influence of the electronic control box 20 on the wind volume and noise of the wind turbine 10.

In some embodiments, the embodiments of the present application do not define the relationship between the length and the height of the electronic control box 20, and in the case where the size of the compressor 40 in the case 110 is large, the embodiments of the present application propose distributing the length direction of the electronic control box 20 along the length direction of the case 110, and the length of the electronic control box 20 being greater than or equal to the height of the electronic control box 20, and reducing the interference between the electronic control box 20 and the compressor 40 in the case 110 by limiting the height of the electronic control box 20.

In some embodiments, in the case where the size of the compressor 40 inside the case 110 is small, and the internal space of the air conditioning outdoor unit 100 and the assembly allow, a vertical electronic control box 20 may be used, the electronic control box 20 is also provided in a rectangular structure, and the height direction of the electronic control box 20 is distributed along the height direction of the case 110, the height of the electronic control box 20 is greater than or equal to the length of the electronic control box 20, for example, the short side b of the electronic control box 20 is placed in a horizontal direction, and the long side a of the electronic control box 20 is placed along a vertical direction, so that the area of the inlet of the wind turbine 10 covered by the electronic control box 20 is minimized. As shown in FIG. 9, the horizontal and vertical electronic control boxes 20 are used in comparison for a certain multi-wind turbine multi-on-line outdoor unit, and it can be seen therefrom that the noise of the wind turbine 10 can be minimized by means of the vertical electronic control box 20.

As shown in FIG. 9, for example, but not limited to: when the air volume is 22000 $m^3/h$, the noise value of the electronic control box 20 horizontally is 61.6 dBA, the noise value of the electronic control box 20 vertically is 60.4 dBA, and the air volume is 23000 $m^3/h$, the noise value of the electronic control box 20 horizontally is 62.5 dBA, the noise value of the electronic control box 20 vertically is 61.5 dBA, and the air volume is 24000 $m^3/h$, the noise value of the electronic control box 20 horizontally is 64 dBA, the noise value of the electronic control box 20 vertically is 62.8 dBA, and the air volume is 25000 $m^3/h$; when the noise value of the electronic control box 20 placed horizontally is 65 dBA, the noise value of the electronic control box 20 placed vertically is 64 dBA, and when the air volume is 26000 $m^3/h$, the noise value of the electronic control box 20 placed horizontally is 66 dBA, and the noise value of the electronic control box 20 placed vertically is 65 dBA.

Fourth Embodiment

As shown in FIGS. 1 to 3, 10, and 12, the present disclosure provides an air conditioning outdoor unit 100 including a case 110, a wind turbine 10, and an electronic control box 20, an air outlet provided on the top of the case 110, a heat exchanger 30 provided inside the case 110, a wind turbine 10 provided on the top of the case 110 and located at the air outlet, and an electronic control box 20 provided on the case 110, where the length of the electronic control box 20 is a, $0.5\times A\leq a\leq K$; A is the length of the whole unit of the air conditioning outdoor unit 100, E is the length of a gap between the heat exchanger 30 and the length of the electronic control box 20, and K is a smaller value between $0.95\times E$ and $0.9\times A$.

In some embodiments, the air conditioning outdoor unit 100 proposed in the embodiments of the present application can flexibly adjust the area of the electronic control box 20 shielding the ventilation channel by reasonably setting the length of the electronic control box 20 under the premise of ensuring the normal operation and convenient assembly and disassembly of the electronic control box 20, and improve the air field and noise inside the case 110 by adjusting the length of the electronic control box 20, to minimize the influence of the electronic control box 20 on the ventilation and noise inside the air conditioning outdoor unit 100.

This embodiment does not limit the number of the wind turbines, and the number of the wind turbines may be one (as shown in FIG. 10), two (as shown in FIG. 12), or any other number.

In one embodiment, the present disclosure provides an air conditioning outdoor unit 100 including a box body 111 and a panel 101. The box body 111 is provided with an opening (as shown in FIG. 2, the opening is located at the panel 101 of the case 110, and the panel 101 covers the opening of the case 110), and the panel 101 is movably connected to the opening to open or close the opening. For example, the panel 101 may be detachably coupled to the box body 111, or the panel 101 may be rotatably coupled to the box body 111. An air outlet is provided at the top of the box body 111.

The number of panels 101 may be one or more. The heat exchanger 30 is provided inside the case 110, an air outlet is provided at the top of the case 110, a fan module 1000 is provided at the top of the case 110 at the position of the air outlet, and a mesh cover 103 is provided at the top of the case 110 at the air outlet side of the air outlet.

The electronic control box 20 is provided in the case 110 at the opening, or the electronic control box 20 is provided at the side of the case 110 near the panel 101, and the electronic control box 20 may be mounted on a support plate (not shown) extending downward from the motor bracket 12. The opening of the case 110 can be opened by adjusting the position of the panel 101 to service the electronic control box 20.

The heat exchanger 30 is disposed inside the case 110 and is circumferentially disposed along an inner wall of the case 110. The heat exchanger 30 is provided with a gap. The gap corresponds to at least a portion of the opening of the box body 111. At least a portion of the electronic control box 20 is disposed in the gap (E is the length of the gap in FIG. 10).

In the embodiments of the present application, the shape of the heat exchanger is not limited. The shape of the heat exchanger 30 may be, for example, but not limited to, a C-type structure, a G-type structure, an L-type structure, or a U-type structure.

The fan module 1000 is used to create an airflow. The fan module 1000 may include a wind turbine 10, a motor 11, a motor bracket 12 and a wind guiding ring 13, the top plate of the electronic control box 20 is located below the motor bracket 12, and during the operation of the fan module 1000, air flows from the inside of the case 110 to the wind turbine 10 and flows out from an air outlet at the top. A mesh cover 103 may be provided at the air outlet.

It can be understood that the heat exchanger 30 and the electronic control box 20 inside the case 110 are both located in an air passage of the airflow, the heat exchanger 30 is used for heat exchange of the airflow at the air passage, and since the heat exchanger 30 is arranged around the periphery of the case 110, the air passage almost completely covers the inner space of the case 110. The electronic control box 20 is arranged in the inner space of the case 110, and the electronic control box 20 blocks a part of the ventilation channel, which may reduce the air output of the air conditioning outdoor unit 100; at the same time, the existence of the electronic control box 20 also interferes with the originally uniform airflow around the wind turbine 10, and the turbulent airflow around the wind turbine 10 may also generate additional pneumatic noise.

In some embodiments, the embodiments of the present application provide the heat exchanger 30 to both maximize the coverage of the inner space of the case 110 and provide sufficient installation space for the electronic control box 20. In the case that the case 110 is a rectangular structure, the heat exchanger 30 is circumferentially arranged along the inner side wall of the case 110 and is provided with a gap (the length E of the gap is shown in FIG. 10) for installing the electronic control box 20.

At the same time, the embodiment of the present application proposes $0.5\times A\leq a\leq K$; A is the length of the whole air conditioning outdoor unit 100, E is the length of the gap on the heat exchanger 30 in the case 110 corresponding to the electronic control box 20, K being a smaller value between $0.95\times E$ and $0.9\times A$; it can be seen therefrom that the electronic control box 20 occupies a sufficiently large space along the length direction; since the wind turbine 10 and the case 110 of the air conditioning outdoor unit 100 are provided with a wind guiding ring 13 and the blade tip clearance, and part of the wind guiding ring 13 and the blade tip clearance are close to the case 110, the air channel located inside the case 110 does not include the wind guiding ring 13 and the blade tip clearance; the portion of the electronic control box 20 along the length direction has less influence on the air duct, and the embodiment of the present application proposes to set the length of the electronic control box 20 to a larger size range, to reduce the influence of the electronic control box 20 on the air volume and noise of the wind turbine 10.

In some embodiments, as shown in FIGS. 4 and 5, in some embodiments, to reduce the obstruction of the air duct by the electronic control box 20, the embodiment of the present disclosure also proposes that the width of the projection of the electronic control box 20 falling on the wind turbine 10 in the vertical direction is T, T satisfying $T\leq 0.15\times D$.

In this embodiment, the electronic control box 20 is integrally located in the inner space of the case 110, and the projected width dimension of the electronic control box 20 falling on the wind turbine 10 in the vertical direction is the projected width dimension of the part of the electronic control box 20 located in the inner space of the case 110 on the wind turbine 10. A wind guiding ring 13 is provided between the wind turbine 10 and the case 110 of the air conditioning outdoor unit 100, and the projection size of the part of the electronic control box 20 located inside the case 110 on the wind turbine 10 in the embodiment of the present application includes the width of the part of the electronic control box 20 located inside the case 110 minus the thickness of the wind guiding ring 13.

As shown in FIG. 1, in the case where the wind guiding ring 13 is provided on the air outlet side of the wind turbine 10, at least part of the electronic control box 20 is located below the wind guiding ring 13, and $T=T1-T2$; T1 is the width of the part of the electronic control box 20 located inside the case 110, and T2 is the thickness of the wind guiding ring 13.

In addition, the embodiment of the present application indirectly defines the width dimension of the electronic control box 20 based on defining the projection dimension of the part of the electronic control box 20 located inside the case 110 on the wind turbine 10, to achieve the purpose of adjusting the wind volume and noise by adjusting the size and position of the electronic control box 20.

Furthermore, the width dimension of the electronic control box 20 falling on the projection of the wind turbine 10 along the vertical direction is $T\leq 0.1\times D$, and the lower limit of the value range of T is determined according to the actual design requirements of the electronic control box 20; the existence of the electronic control box 20 blocks the air inlet of the wind turbine 10, and at the same time reducing the amount of air inlet, also causes the phenomenon of uneven air inlet of the wind turbine 10; and the embodiment of the present application is one of the effective methods for reducing the influence of the electronic control box 20 on the inlet flow field of the wind turbine 10 by reducing the width of the electronic control box 20. As shown in FIG. 8, through experiments, in the case T/D≤0.15, the influence of the electronic control box 20 on the flow field and noise at the inlet of the wind turbine 10 is minimal, the noise at the inlet of the wind turbine 10 can be reduced to 61.58 or less, for example, but not limited to: when T/D=0.1, the noise value is 61.4 dBA, when T/D=0.08, the noise value is 61.4 dBA, when T/D=0.06, the noise value is 61.3 dBA, when T/D=0.04, the noise value is 61.2 dBA, when=T/D=0.02, the noise value is 61.1 dBA.

Alternatively, a support beam 104 is provided in the middle part of the case 110, and at least part of the electronic control box 20 is located below the support beam 104. Since the support beam 104 is not located below the air channel of the air conditioning outdoor unit 100, the embodiments of the present application propose that at least part of the electronic control box 20 is located below an adjacent support beam 104, so that the shielding of the air channel at the inlet of the wind turbine 10 by the electronic control box 20 can be reduced, facilitating the lifting of the air volume and controlling the interference noise.

As shown in FIGS. 11 and 12, in some embodiments, the air conditioning outdoor unit 100 includes two heat exchangers 30 oppositely disposed in a length direction, which cooperate to form gaps for mounting the heat exchangers.

As shown in FIG. 11, the length of the electronic control box 20 is a, and 0.32×A≤a≤K, where A is the whole length of the air conditioning outdoor unit 100, and F is the length of the gap, K being a smaller value between 0.95×F and 0.9×A.

In the embodiment of the present application, two adjacent heat exchangers 30 cooperate to form a gap for mounting the electronic control box 20, to reduce interference between the electronic control box 20 and the heat exchangers 30 during the process of crossing the air conditioning outdoor unit 100, and reducing the influence of the electronic control box 20 on the air volume and noise in the case 110 by defining the length a of the electronic control box 20.

As shown in FIG. 12, in some embodiments, the air conditioning outdoor unit 100 includes a U-type heat exchanger (FIG. 12) or a G-type heat exchanger (not shown), which is disposed around the inner wall of the case 110. The width F of the gap satisfies the range mentioned in the above embodiment.

In some embodiments, the case 110 is a rectangular structure, the air outlet at the top of the case 110 is provided in a rectangular structure or a circular structure, and the wind guiding ring 13 is provided in a circular structure. By arranging the electronic control box 20 inside the case 110, the electronic control box 20 can be located at the corner between the wind guiding ring 13 and the case 110, to minimize the interference of the electronic control box 20 on the air passage and improving the ventilation performance and noise reduction capability of the wind turbine 10.

In some embodiments, as shown in FIGS. 1-3, according to an embodiment of the present application, the distance between the top of the electronic control box 20 and the bottom of the wind turbine 10 is $Z_1$, then $0.1\times D\leq Z_1\leq 0.2\times D$, where D is the diameter of the wind turbine 10 and $Z_1$ is the distance between the top of the electronic control box 20 and the bottom of the wind turbine 10.

In some embodiments, the air conditioning outdoor unit 100 reduces the adverse effect of the electronic control box 20 on the air conditioning outdoor unit 100 and reduces the air volume loss and the noise caused by the electronic control box 20 by rationally arranging the distance between the electronic control box 20 and the wind turbine 10 on the premise that the electronic control box 20 is ensured to be normally operated and conveniently maintained. The distance between the top of the electronic control box 20 to the bottom of the wind turbine 10 described in the embodiments of the present disclosure is the minimum distance of the vertical distance between the top of the electronic control box 20 to the bottom of the wind turbine 10.

In particular, if the distance between the top of the electronic control box 20 and the bottom of the wind turbine 10 is $Z_1$, and the diameter of the wind turbine 10 is D, the influence of the electronic control box 20 on the air volume and noise in the case 110 can be effectively improved if $0.1\times D\leq Z_1\leq 0.2\times D$ satisfied, the internal structure and size of the case 110 have a greater influence on the air volume and noise in the case 110, and the air volume and noise generated by different cases 110 are different, and an example of all the different cases 110 will not be given here. As shown in FIG. 7, the embodiments of the present application only illustrate that the amount of wind and noise within one type of case 110 is affected by the distance $Z_1$ from the top of the electronic control box 20 to the bottom of the wind turbine 10. In one embodiment, by increasing the axial spacing between the electronic control box 20 and the wind turbine 10, the effect of the electronic control box 20 on the flow field at the inlet of the wind turbine 10 can be reduced, and within the above-mentioned distance $0.14\times D\leq Z_1\leq 0.16\times D$ range, in particular within the range, the effect of the electronic control box 20 on the wind turbine 10 is small, facilitating the generation of a higher air volume and the control of noise.

D has a range of values from 500 mm to 920 mm and may be, for example but not limited to: when D=500 mm, 50 mm≤$Z_1$≤100 m, when D=600 mm, 60 mm≤$Z_1$≤120 mm, when D=700 mm, 70 mm≤$Z_1$≤140 mm, when D=800 mm, 80 mm≤$Z_1$≤160 mm, when D=920 mm, 92 mm≤$Z_1$≤184 mm.

As shown in FIG. 7, when satisfied $0.1\leq Z_1/D\leq 0.16$, the ratio of the noise value to the air volume in the case 110 can be minimum, and in this case, the ratio of the noise value to the air volume in the case 110 is between 5.08 and 5.2, for example, but not limited to: when $Z_1/D=0.1$, the ratio of noise value to air volume is 5.2, when $Z_1/D=0.12$, the ratio of noise value to air volume is 5.12, when $Z_1/D=0.13$, the ratio of noise value to air volume is 5.09, when $Z_1/D=0.14$, the ratio of noise value to air volume is 5.07, and when $Z_1/D=0.16$, the ratio of noise value to air volume is 5.09.

In some embodiments, the distance from the bottom of the electronic control box 20 to the bottom of the case 110 is $Z_2$, $Z_2\geq 0.8\times h$, where $Z_2=H-b$, then $(H-b)\geq 0.8h$, H being the vertical distance from the top of the electronic control box 20 to the bottom of the case 110, and h being the height of the compressor assembly.

In the present embodiment, the embodiment of the present application proposes to improve the airfield and noise inside the case 110 by adjusting the position of the electronic control box 20. In one embodiment, under the premise of ensuring the normal operation and convenient maintenance of the air conditioning outdoor unit, by rationally arranging the distance between the electronic control box 20 and the bottom of the case, the height direction of the electronic control box 20 can be flexibly adjusted, to reduce the influence of the electronic control box 20 on the ventilation and noise inside the air conditioning outdoor unit.

The compressor assembly includes a compressor 40 and a mounting support, where the mounting support is provided on a baseplate 102 of a box body 111, the compressor 40 is mounted on the baseplate 102 of the box body 111 via the mounting support, and the height of the compressor assembly includes the height of the compressor 40 and the height of the mounting support.

In addition, the embodiments of the present application can also achieve the purpose of defining the overall height of the electronic control box 20 by defining $Z_1$ value and $Z_2$ value, that is to say, the embodiments of the present application actually indirectly define the overall height dimension of the electronic control box 20 based on defining the top height and the bottom height of the electronic control box 20, to achieve the purpose of adjusting the air volume and noise at the wind turbine 10 by adjusting the size and height position of the electronic control box 20.

Referring to FIGS. 6 and 11, in some embodiments, the air conditioning outdoor unit 100 may include two wind turbines 10, one wind guiding ring 13 is provided at the air outlet of each wind turbine, and $(W+\sqrt{R^2-(R-T)^2})-L_0 \leq L \leq \sqrt{R^2-(R-T)^2}$, where W is the width of the electronic control box 20, R is the inner diameter of the wind guiding ring 13 of the wind turbine 10, $L_0$ is the axial distance between the two wind turbines 10, T is the width dimension of the projection of the electronic control box 20 falling on the wind turbine 10 in the vertical direction, and L is the distance between one side of the electronic control box 20 and one side of the axial center of the wind turbine 10 along the length direction of the air conditioning outdoor unit 100.

In the present embodiment, the part of the electronic control box 20 is located at the middle connection part of the two wind guiding rings 13 of the two wind turbines 10, and the middle connection part of the two wind guiding rings 13 is not located at the air channel of the air conditioning outdoor unit 100. The embodiment of the present application proposes that the air outlet side of each wind turbine 10 is provided with one wind guiding ring 13, and at least part of the electronic control box 20 is located below the two adjacent wind guiding rings 13, which can reduce the shielding of the air channel at the inlet of the wind turbine 10 by the electronic control box 20, facilitating the increase of the air volume and controlling the interference noise. In addition, on the basis that the overall length value of the air conditioning outdoor unit 100 is fixed, the embodiment of the present application actually indirectly defines the length dimension of the electronic control box 20 by defining the distance along the length direction from one side of the electronic control box 20 to one side of the axial center of the wind turbine 10, to achieve the purpose of adjusting the air volume and noise by adjusting the size and position of the electronic control box 20.

In addition, the embodiment of the present application also provides that the electronic control box 20 is symmetrically distributed with respect to the central axis of the vertical direction of the box body or symmetrically distributed with respect to the support beam 104, and the distance from one side of the electronic control box 20 along the length direction to the axial center of one side wind turbine is equal to the distance from the other side of the electronic control box 20 along the length direction to the axial center of the other side wind turbine, that is to say, on the basis that the overall length of the air conditioning outdoor unit 100 is fixed, the embodiment of the present application defines the distance from one side of the electronic control box 20 to the axial center of one side wind turbine 10 along the length direction of the whole air conditioning outdoor unit 100. And based on defining the distance from the other side of the electronic control box 20 to the axial center of the wind turbine 10 along the length direction of the whole machine, the length dimension of the electronic control box 20 is also indirectly defined, to achieve the purpose of adjusting the air volume of the wind turbine 10 and the noise of the wind turbine 10 by adjusting the size and position of the electronic control box 20. The support beam 104 of the present application does not define a shape. A structure located at the middle part of the top of the case 110 and connecting two sides of the top of the case 110 for increasing the strength of the top of the case 110 can be understood as a support beam 104.

In some embodiments, the embodiment of the present application sets the electronic control box 20 as a rectangular structure, and sets the length direction of the electronic control box 20 along the length direction of the machine case 110, to reduce the influence of the electronic control box 20 on the ventilation inside the machine case 110, and at the same time, the electronic control box 20 blocks the ventilation channel inside the machine case 110 in the width direction, and the embodiment of the present application proposes to minimize the width of the electronic control box 20, to reduce the influence of the electronic control box 20 on the wind volume and noise of the wind turbine 10.

In some embodiments, the embodiments of the present application do not define the relationship between the length and the height of the electronic control box 20. In the case where the size of the compressor 40 in the case 110 is large, the embodiments of the present application propose to distribute the length direction of the electronic control box 20 along the length direction of the case 110, and the length of the electronic control box 20 is greater than the height of the electronic control box 20, to reduce the interference between the electronic control box 20 and the compressor 40 in the case 110 by limiting the height of the electronic control box 20.

In some embodiments, in the case where the size of the compressor 40 inside the case 110 is small, and the internal space of the air conditioning outdoor unit 100 and the assembly allow, it is possible to adopt the manner of the vertical electronic control box 20, the electronic control box 20 is also provided in a rectangular structure, and the height direction of the electronic control box 20 is distributed along the height direction of the case 110, and the height of the electronic control box 20 is greater than the length of the electronic control box 20, namely, the short side b of the electronic control box 20 is placed in a horizontal direction, and the long side a of the electronic control box 20 is placed along a vertical direction, so that the area of the electronic control box 20 shielding the inlet of the wind turbine 10 is minimized. As shown in FIG. 9, the horizontal electronic control box 20 is compared with the vertical discharge for a certain multi-line outdoor unit, and it can be seen therefrom that the noise of the wind turbine 10 can be minimized by means of the vertical electronic control box 20.

For example, but not limited to: when the air volume is 22000 $m^3/h$, the noise value of the electronic control box 20 horizontally is 61.6 dBA, the noise value of the electronic control box 20 vertically is 60.4 dBA, and the air volume is 23000 $m^3/h$, the noise value of the electronic control box 20 horizontally is 62.5 dBA, the noise value of the electronic control box 20 vertically is 61.5 dBA, and the air volume is 24000 $m^3/h$, the noise value of the electronic control box 20 horizontally is 64 dBA, the noise value of the electronic control box 20 vertically is 62.8 dBA, and the air volume is 25000 $m^3/h$; when the noise value of the electronic control box 20 placed horizontally is 65 dBA, the noise value of the electronic control box 20 placed vertically is 64 dBA, and when the air volume is 26000 $m^3/h$, the noise value of the electronic control box 20 placed horizontally is 66 dBA, and the noise value of the electronic control box 20 placed vertically is 65 dBA.

An embodiment of the present disclosure provides an air conditioner including the air conditioning outdoor unit 100 of the present disclosure.

In the present embodiment, the air conditioner can be a conventional air conditioner, including an indoor unit of an air conditioner and an air conditioning outdoor unit 100, where the air conditioning outdoor unit 100 can be a double-wind turbine multi-unit outdoor unit, a three-wind turbine multi-unit outdoor unit or a four-wind turbine multi-unit outdoor unit, and the like, and all the air conditioners with these structures fall within the scope of protection of the present application. In addition, the air conditioner provided in the present disclosure has all the effects of the air conditioning outdoor unit 100 provided in the present application, which will not be described in detail herein.

What is claimed is:

1. An air conditioning outdoor unit, comprising:

a case, wherein an air outlet is provided at a top of the case, and a compressor assembly is provided at a bottom of the case;

a wind turbine, wherein the wind turbine is arranged at the top of the case and is located at a position of the air outlet; and an electronic control box, wherein the electronic control box is arranged at the case, and a distance between a bottom of the electronic control box and the bottom of the case is $Z_2$, $Z_2 \geq 0.8 \times h$, h being a height of the compressor assembly.

2. An The air conditioning outdoor unit according to claim 1, wherein a projection of the electronic control box toward the bottom of the case along a vertical direction is outside the compressor assembly.

3. An The air conditioning outdoor unit according to claim 1, wherein a top of the compressor assembly is an arc-shaped structure, and the height h of the compressor assembly is a maximum distance between the top of the compressor assembly and the bottom of the case.

4. An The air conditioning outdoor unit according to claim 1, wherein a distance between a top of the electronic control box and a bottom of the wind turbine is $Z_1$, and $0.1 \times D \leq Z_1 \leq 0.2 \times D$, D being a diameter of the wind turbine, wherein the electronic control box is a rectangular structure, and a length direction of the electronic control box is distributed along a length direction of the case, and a length of the electronic control box is greater than a height of the electronic control box, wherein the electronic control box is a rectangular structure, a height direction of the electronic control box is distributed along a height direction of the case, and a height of the electronic control box is greater than a length of the electronic control box, and wherein the compressor assembly comprises a compressor and a mounting support, the mounting support is provided at a baseplate of the case, and the compressor is mounted on the baseplate through the mounting support.

5. The air conditioning outdoor unit of claim 1, wherein two heat exchangers are oppositely disposed in a case of the air conditioning outdoor unit along a length direction; the two heat exchangers cooperate to form a gap for accommodating an electronic control box of the air conditioning outdoor unit; at least a portion of the electronic control box is disposed in the gap; and a length of the electronic control box is a, and $0.32 \times A \leq a \leq K$, A being an entire length of the air conditioning outdoor unit, F being a length of the gap, and K being a smaller value between $0.95 \times F$ and $0.9 \times A$, wherein the top of the case is provided with a support beam connecting two long sides of the top of the case, and at least a portion of the electronic control box is positioned below the support beam, wherein a width of a projection of the electronic control box falling on the wind turbine along a vertical direction is T, and $T \leq 0.15 \times D$, D being a diameter of the wind turbine, wherein the electronic control box has a height of b, and $(H-b) \geq 0.8h$, H being a vertical distance between a top of the electronic control box and a bottom of the case, and h being a height of a compressor assembly in the case, wherein the electronic control box is a rectangular structure, a length direction of the electronic control box is distributed along a length direction of the case, and a length of the electronic control box is greater than a height of the electronic control box, and wherein the electronic control box is a rectangular structure, a height direction of the electronic control box is distributed along a height direction of the case, and a height of the electronic control box is greater than a length of the electronic control box.

6. An air conditioner, comprising the air conditioning outdoor unit according to claim 1.

7. The air conditioning outdoor unit of claim 1, $0.1 \times D \leq Z_1 \leq 0.2 \times D$, D being a diameter of the wind turbine, and $Z_1$ being a distance between a top of the electronic control box and a bottom of the wind turbine, wherein a distance between a bottom of the electronic control box and a bottom of the case is $Z_2$, $Z_2 \geq 0.8 \times h$, h being a height of a compressor assembly in the case, wherein a width of the electronic control box on the wind turbine along a vertical direction is T, and $T \leq 0.15 \times D$, wherein a heat exchanger of the air conditioning outdoor unit is circumferentially disposed along an inner sidewall of the case and provided with a gap for disposing the electronic control box, wherein the air conditioning outdoor unit comprises two heat exchangers oppositely disposed along a length direction, the two heat exchangers cooperating to form the gap; a length of the electronic control box is a, and $0.32 \times A \leq a \leq K$, A being an entire length of the air conditioning outdoor unit, F being a length of the gap, and K being a smaller value between $0.95 \times F$ and $0.9 \times A$, wherein a shape of a heat exchanger is one of a C-type structure, a U-type structure, a G-type structure, and an L-type structure, and wherein the air conditioning outdoor unit comprises a heat exchanger; the electronic control box has a length a, and $0.5 \times A \leq a \leq K$, A being an entire length of the air conditioning outdoor unit, E being a length of a gap, and K being a smaller value between $0.95 \times E$ and $0.9 \times A$.

8. The air conditioning outdoor unit according to claim 7, wherein the air conditioning outdoor unit satisfies $(W+\sqrt{R^2-(R-T)^2})-L_0 \leq L \leq \sqrt{R^2-(R-T)^2}$; W is a width of the electronic control box, R is an inner diameter of a wind guiding ring of the wind turbine, $L_0$ is an axial distance between two wind turbines, T is a width of a projection of the electronic control box on the wind turbine along a vertical direction, and L is a distance from one side of the electronic control box to one side of the axis of the wind turbine in an entire length direction of the air conditioning outdoor unit, wherein the electronic control box is a rectangular structure, a length direction of the electronic control box is distributed along a length direction of the case, and a length of the electronic control box is equal to or greater than a height of the electronic control box.

9. The air conditioning outdoor unit according to claim 8, wherein the electronic control box is a rectangular structure, a height direction of the electronic control box is distributed along a height direction of the case, and a height of the electronic control box is equal to or greater than a length of the electronic control box.

10. The air conditioning outdoor unit according to claim 7, wherein the electronic control box is at least partially disposed inside the case.

11. The air conditioning outdoor unit of claim 1, further comprising a heat exchanger, wherein the heat exchanger is provided inside the case, and the heat exchanger is provided with a gap for accommodating the electronic control box; the wind turbine is arranged at the top of the case and is located at the air outlet; the electronic control box is arranged at the case and is at least partially located at the gap, and a length of the electronic control box is a, and $0.5\times A\leq a\leq K$, A being an entire length of the air conditioning outdoor unit, E being a length of the gap, and K being a smaller value between $0.95\times E$ and $0.9\times A$.

12. The air conditioning outdoor unit according to claim 11, wherein the heat exchanger is circumferentially disposed along an inner sidewall of the case and provided with a gap for mounting the electronic control box.

13. The air conditioning outdoor unit according to claim 11, wherein the electronic control box is a hermetic electronic control box.

14. An air conditioning outdoor unit, comprising:

a case, wherein an air outlet is provided at a top of the case;

a wind turbine, wherein the wind turbine is arranged at the top of the case and is located at the air outlet; and an electronic control box, wherein the electronic control box is arranged at the case and is located below the wind turbine, and a width of a projection of the electronic control box falling on the wind turbine along a vertical direction is T, and $T\leq 0.15\times D$, D being a diameter of the wind turbine.

15. The air conditioning outdoor unit according to claim 14, wherein a wind guiding ring is provided at an air outlet side of the wind turbine, at least a portion of the electronic control box is located below the wind guiding ring, and $T=T1-T2$, T1 being a width of a portion of the electronic control box located inside the case, and T2 is a thickness of the wind guiding ring.

16. The air conditioning outdoor unit according to claim 14, wherein a distance between a bottom of the electronic control box and a bottom of the case is $Z_2$, $Z_2\geq 0.8\times h$, h being a height of a compressor assembly in the case.

17. The air conditioning outdoor unit according to claim 14, wherein a distance between a top of the electronic control box and a bottom of the wind turbine is $Z_1$, and $0.1\times D\leq Z_1\leq 0.2\times D$.

18. An air conditioning outdoor unit, comprising:

a case, wherein air outlets are provided at a top of the case;

at least two wind turbines, wherein the at least two wind turbines are arranged at the air outlets; and an electronic control box, wherein the electronic control box is arranged at the case and spans two adjacent wind turbines, and is located below the two adjacent wind turbines; a projected area of the electronic control box on the wind turbines along a vertical direction is S, and $0.5(2\times S1+S2)\leq S\leq(2\times S1+S2)$, wherein $$S1 = R\cdot T\cdot \sin(a) - \frac{(A-\sin(a))R^{\wedge}2 + TR\sin(a)}{2},$$

and $S2=T\cdot(L_0-2R)$; R is a radius of a wind guiding ring of the wind turbine, T is a width of the projection of the electronic control box falling on the wind turbines in the vertical direction, $a=\arccos(R-T/R)$ with a unit of degree, $A=a\cdot\pi/180$, and $L_0$ is an axial distance between the two adjacent wind turbines.

19. The air conditioning outdoor unit according to claim 18, wherein a width of the projection of the electronic control box falling on the at least two wind turbines in the vertical direction is T, and $T\leq 0.15\times D$, D being a diameter of the at least two wind turbine.

20. The air conditioning outdoor unit according to claim 18, wherein the case is provided with a support beam located between two adjacent air outlets, and at least a portion of the electronic control box is located below the support beam.

* * * * *